US011196178B2

(12) United States Patent
Fleancu et al.

(10) Patent No.: US 11,196,178 B2
(45) Date of Patent: Dec. 7, 2021

(54) DUAL-POLARIZED HORN RADIATOR

(71) Applicant: Telefonaktiebolaget LM Ericsson (publ), Stockholm (SE)

(72) Inventors: Dan Fleancu, Griesstätt (DE); Andreas Vollmer, Rosenheim (DE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 0 days.

(21) Appl. No.: 16/466,012

(22) PCT Filed: Dec. 1, 2017

(86) PCT No.: PCT/EP2017/081124
§ 371 (c)(1),
(2) Date: May 31, 2019

(87) PCT Pub. No.: WO2018/100133
PCT Pub. Date: Jun. 7, 2018

(65) Prior Publication Data

US 2020/0006863 A1 Jan. 2, 2020

(30) Foreign Application Priority Data

Dec. 2, 2016 (DE) ..... 10 2016 014 385.1

(51) Int. Cl.
*H01Q 21/06* (2006.01)
*H01Q 1/24* (2006.01)
(Continued)

(52) U.S. Cl.
CPC ..... *H01Q 21/064* (2013.01); *H01Q 1/24* (2013.01); *H01Q 1/246* (2013.01); *H01Q 13/02* (2013.01);
(Continued)

(58) Field of Classification Search
CPC ..... H01Q 21/064; H01Q 21/0025; H01Q 13/0225; H01Q 13/0258; H01Q 21/06;
(Continued)

(56) References Cited

U.S. PATENT DOCUMENTS 2,965,898 A * 12/1960 Lewis ..... H01Q 25/04 342/365
2,972,148 A * 2/1961 Rupp ..... H01Q 25/001 343/776
(Continued)

FOREIGN PATENT DOCUMENTS

AU 688212 B2 12/1996
CN 201060943 Y 5/2008
(Continued)

OTHER PUBLICATIONS

ISA European Patent Office, International Search Report Issued in Application No. PCT/EP2017/081124, dated May 23, 2018, WIPO, 14 pages.
(Continued)

*Primary Examiner* — Hai V Tran
(74) *Attorney, Agent, or Firm* — Withrow & Terranova, PLLC

(57) ABSTRACT

Disclosed is a dual polarized horn radiator, in particular for a cellular radio base station, having a first polarization and a second polarization that are fed separately via a first hollow waveguide and a second hollow waveguide. In a first aspect one of the hollow waveguides runs in the direction of beam to its opening into the horn radiator and in so doing has a cross-section that extends in projection onto the aperture plane partially within and partially outside the aperture opening of the horn radiator. In a second aspect the two hollow waveguides run in the direction of beam to their openings into the horn radiator, with at least one of the hollow waveguides having a transformation section by
(Continued)

which its polarization in the aperture plane is rotated with respect to the other hollow waveguide before it opens into the horn radiator.

14 Claims, 24 Drawing Sheets

(51) Int. Cl.
*H01Q 25/00* (2006.01)
*H01Q 13/02* (2006.01)
*H01Q 21/24* (2006.01)
*H01Q 21/00* (2006.01)

(52) U.S. Cl.
CPC ..... *H01Q 13/0225* (2013.01); *H01Q 13/0258* (2013.01); *H01Q 21/0025* (2013.01); *H01Q 21/06* (2013.01); *H01Q 21/24* (2013.01); *H01Q 25/00* (2013.01); *H01Q 25/001* (2013.01)

(58) Field of Classification Search
CPC ..... H01Q 1/24; H01Q 21/24; H01Q 25/001; H01Q 1/246; H01Q 21/00
USPC ..... 343/786
See application file for complete search history.

(56) References Cited

U.S. PATENT DOCUMENTS 3,274,604 A * 9/1966 Lewis ..... H01Q 25/04 343/786
4,097,869 A * 6/1978 Robinson ..... G01S 3/28 343/773
4,246,583 A * 1/1981 Profera ..... H01Q 25/04 333/21 R
4,473,828 A * 9/1984 Morz ..... H04B 7/10 333/137
4,716,415 A 12/1987 Kelly
4,797,681 A * 1/1989 Kaplan ..... H01Q 13/0258 333/137
4,996,535 A * 2/1991 Profera, Jr. ..... H01Q 13/0258 333/21 A
4,998,113 A * 3/1991 Raghavan ..... H01Q 13/02 333/135
5,818,396 A 10/1998 Anderson et al.
7,187,342 B2 3/2007 Heisen et al.
7,564,421 B1 7/2009 Edwards et al.
8,988,294 B2 3/2015 Voss et al.
2002/0011964 A1* 1/2002 Yuanzhu ..... H01P 1/172 343/786
2009/0213022 A1* 8/2009 Lier ..... H01Q 15/0086 343/785
2010/0078203 A1* 4/2010 Lier ..... H01Q 13/0275 174/258
2010/0123636 A1 5/2010 Bezuidenhout et al.
2011/0267250 A1 11/2011 Seifried et al.
2013/0120086 A1 5/2013 Sarasa Delgado
2015/0288068 A1* 10/2015 Suematsu ..... H01Q 5/45 343/776
2017/0077610 A1* 3/2017 Bongard ..... H01Q 21/24

FOREIGN PATENT DOCUMENTS

| | | | |
|---|---|---|---|
| CN | 101083359 | B | 5/2012 |
| CN | 102938497 | A | 2/2013 |
| CN | 103390798 | A | 11/2013 |
| CN | 103474787 | A | 12/2013 |
| CN | 203326116 | U | 12/2013 |
| CN | 104332714 | B | 5/2017 |
| DE | 4009288 | A1 | 9/1991 |
| DE | 3787681 | T2 | 5/1994 |
| DE | 102010019081 | A9 | 4/2012 |
| DE | 102016014385 | A1 | 6/2018 |
| EP | 0089084 | A1 | 9/1983 |
| EP | 1109252 | A3 | 6/2001 |
| EP | 2869400 | A1 | 5/2015 |
| FR | 2599899 | A1 | 12/1987 |
| GB | 551585 | A | 3/1943 |
| KR | 100801030 | B1 | 2/2008 |
| KR | 20090038803 | A | 4/2009 |
| KR | 101090188 | B1 | 12/2011 |
| RU | 2292098 | C1 | 1/2007 |
| WO | 9523440 | A1 | 8/1995 |
| WO | 9708775 | A1 | 3/1997 |
| WO | 2007046055 | A2 | 4/2007 |
| WO | 2008147132 | A1 | 12/2008 |
| WO | 2009008601 | A1 | 1/2009 |
| WO | 2009093779 | A1 | 7/2009 |
| WO | 2014208993 | A1 | 12/2014 |
| WO | 2015134772 | A1 | 9/2015 |

OTHER PUBLICATIONS

Search Report for Chinese Patent Application No. 201780085268, dated Aug. 25, 2020, 2 pages.
First Office Action for Chinese Patent Application No. 201780085268, dated Sep. 2, 2020, 13 pages.
Examination Report for European Patent Application No. 178080685, dated Sep. 15, 2020, 5 pages.
Written Opinion for International Application No. PCT/EP2017/081124, dated May 23, 2018, 41 pages.
The Second Office Action for Chinese Patent Application No. 201780085268.1, dated May 25, 2021, 8 pages.
Examination Report for European Patent Application No. 17808068.5, dated Jan. 18, 2021, 11 pages.
Rong, Yu, et al., "Characteristics of Generalized Rectangular and Circular Ridge Waveguides," IEEE Transactions on Microwave Theory and Techniques, vol. 48, Issue 2, Feb. 2000, pp. 258-265.
Sun, Weimin, et al., "MFIE Analysis and Design of Ridged Waveguides," IEEE Transactions on Microwave Theory and Techniques, vol. 41, Issue 11, Nov. 1993, pp. 1965-1971.
Notification to Grant for Chinese Patent Application No. 201780085268.1, dated Aug. 18, 2021, 4 pages.

* cited by examiner

DUAL-POLARIZED HORN RADIATOR

CROSS REFERENCE TO RELATED APPLICATIONS

The present application is a U.S. National Phase of International Patent Application Serial No. PCT/EP2017/081124 entitled "DUAL-POLARIZED HORN RADIATOR" filed on Dec. 1, 2017. International Patent Application Serial No. PCT/EP2017/081124 claims priority to German Patent Application No. 10 2016 014 385.1, filed on Dec. 2, 2016. The entire contents of each of the above-cited applications are hereby incorporated by reference for all purposes.

TECHNICAL FIELD

The present invention relates to a dual polarized horn radiator having a first polarization and a second polarization that are fed separately from one another via a first hollow waveguide and a second hollow waveguide. The present invention in particular relates to such a dual polarized horn radiator for use as a cellular radio antenna, in particular for a cellular radio base station.

BACKGROUND AND SUMMARY

Horn radiators are also called hollow waveguide radiators and typically have a horn, i.e. a hollow body that is open to one side and that is fed by a hollow waveguide. Radiators on the basis of hollow waveguide technology typically have large dimensions and are therefore not suitable for a compact construction. Horn radiators have therefore to date been considered less suitable for 3D beam steering and 3D beam forming applications since a radiator distance of less than 1λ, preferably less than 0.7λ, and in particular less than 0.5λ, in the vertical and horizontal directions is of advantage for this purpose. Smaller single radiator distances in particular improve the far field group diagram since no secondary main lobes occur in the far field group diagram with a single radiator distance of less than 0.5λ. With a single radiator distance of more than 0.5λ, in contrast, secondary main lobes or high side lobes may occur during beam forming and/or beam steering that increase as the single radiator distance increases in dependence on the single radiator diagram. The larger the secondary main lobes and the side lobes are, the more difficult it becomes to pivot the main lobes in one direction and thus to utilize the antenna for beam forming or beam steering applications.

Dual polarizing horn radiators represent a special challenge with respect to the compactness and the electrical performance here since one radiator is used for two polarizations that differ as a rule in this process. Compact dual polarized horn radiators are typically fed by two separate orthogonal waveguides or by one dual polarized hollow waveguide.

The use of two separate orthogonal waveguides is known, for example, from WO 9837595 A1. The use of a single dual polarized hollow waveguide is known from US 20130120086 A1.

Further horn radiators are known from WO 2015134772 A1, DE 102010019081 A9, KR 100801030 B1, US 2011267250 A1 and DE 102010019081 A9, FR 2523376 A1, FR 2599899 A1, U.S. Pat. No. 7,187,342 B2, and WO 2007046055 A2. Further horn radiators are known from AT 202658 T, DE 3375867 D1, DE 3787681 D1, AU 688212 B2, U.S. Pat. No. 4,716,415 A, CN 101083359 B, CN 201060943 Y, U.S. Pat. No. 7,564,421 B1, CN 203326116 U, WO 2014208993 A1, EP 2869400 A1, WO 2008147132 A1, WO 2009008601 A1, KR 20090038803 A, WO 2009093779 A1, KR 101090188 B1, and U.S. Pat. No. 8,988,294 B2

It is therefore the object of the present invention to provide a compact dual polarized horn radiator having good electrical performance.

This object is achieved in accordance with the invention by the dual polarized horn radiators in particular for a cellular radio base station, having a first polarization and having a second polarization that are fed separately from one another via a first hollow waveguide and a second hollow waveguide, characterized in that one of the hollow waveguides, and in particular the first hollow waveguide, runs in the direction of beam to its opening into the horn radiator and in so doing has a cross-section that extends in projection onto the aperture plane partly within and partly outside the aperture orifice of the horn radiator. In another aspect, the two hollow waveguides run in the direction of beam to their openings into the horn radiator, with at least one of the hollow waveguides, and in particular the first hollow waveguide, having a transformation section by which its polarization is rotated in the aperture plane with respect to the other hollow waveguide before it opens into the horn radiator. In some aspects, a plurality of dual polarized horn radiators may be arranged next to each other in a column or row as a radiator array in which the hollow waveguides of a column or row are each guided in the direction of beam to their openings into the horn radiators, with every second hollow waveguide in the column or row having a transformation section by which its polarization in the aperture plane is rotated before it opens into the horn radiator; and/or in that a respective hollow waveguide, and in particular the first hollow waveguide, of a horn radiator runs in the direction of beam to its opening into the horn radiator and in so doing its cross-section runs in projection onto the aperture plane at least partly below the aperture orifice of an adjacent horn radiator In a first aspect, the present invention relates to a dual polarized horn radiator having a first polarization and a second polarization that are fed separately from one another via a first hollow waveguide and a hollow second waveguide. In accordance with the invention, provision is made in accordance with the first aspect that one of the hollow waveguides, and in particular the first hollow waveguide, runs in the direction of the beam to its opening into the horn radiator and in so doing has a cross-section that extends in projection onto the aperture plane partially within and partially outside the aperture orifice of the horn radiator. The hollow waveguides can be guided in a tight space to the horn radiator by the guidance of the hollow waveguide in the direction of the beam. The horn radiator can have a very compact design due to the cross-section that extends partly within and partly outside the aperture opening since its minimal size is no longer limited by the cross-sections of the hollow waveguides.

In a possible embodiment, the cross-section of the hollow waveguide runs in projection onto the aperture plane partly below the aperture orifice of an adjacent horn radiator. The space available in a radiator array is hereby ideally used and adjacent radiators are arranged very compactly next to one another.

The indications on the extent of a cross-section of the hollow waveguide in this respect preferably relate to the cross-section of the hollow waveguide at the level of the lowest point of the opening of the hollow waveguide into the horn radiator normal to the aperture plane with respect to a direction.

In a possible embodiment, the hollow waveguide has an end-face boundary wall that extends from a position that is disposed outside the aperture orifice of the horn radiator in projection onto the aperture plane to an edge of the opening into the horn radiator. The boundary wall is preferably the wall of a short side of the hollow waveguide. The electromagnetic field is hereby led into the horn of the horn radiator. The boundary wall preferably runs obliquely to the aperture plane.

The present invention in a second aspect comprises a dual polarized horn radiator having a first polarization and a second polarization that are fed separately from one another via a first waveguide and a second waveguide. Provision is made in accordance with the second aspect that the two hollow waveguides run in the direction of the beam to their openings into the horn radiator, with at least one of the hollow waveguides, and in particular the first hollow waveguide, having a transformation section by which its polarization in the aperture plane is rotated with respect to the other hollow waveguide before it opens in the horn radiator. This in turn makes a very compact arrangement of the hollow waveguides possible.

In a possible embodiment, the two hollow waveguides run next to one another and/or in parallel with one another in the direction of the beam to their openings into the horn radiator.

In a possible embodiment, the two hollow waveguides run next to one another and/or in parallel with one another in the direction of beam to their openings into the horn radiator.

In a possible embodiment, the two hollow waveguides first have the same polarization before the polarization of the one hollow waveguide is rotated with respect to the other hollow waveguide by the transformation section in the aperture plane.

Provision can furthermore be made that the transmission section has a twist by which the polarization is rotated.

In a possible embodiment, the polarization of the second hollow waveguide is not rotated or the second hollow waveguide has a transformation section in which a polarization takes place about a different angle and in particular in the opposite direction than in the first hollow waveguide. The second hollow waveguide can therefore in particular have no twist or a twist having a different angle than the first hollow waveguide.

The two hollow waveguides can in particular first have the same polarization, with only the polarization of the first hollow waveguide being rotated by 90° to be orthogonal to the polarization of the second hollow waveguide in the region of the opening into the horn radiator.

In a preferred embodiment, the cross-section of the first hollow waveguide reduces in size in the transformation section. Alternatively or additionally, the second hollow waveguide can have a transformation section in which its cross-section reduces in size.

In a possible embodiment, the two hollow waveguides have a cross-section having a long side and a short side, in particular a rectangular cross-section.

In a further possible embodiment, the hollow waveguides have at least one cross-section constriction and/or at least one cross-section widening.

The cross-sections of adjacent hollow waveguides can furthermore be interleaved with one another. A cross-section widening or an end section of the cross-section of a hollow waveguide can, for example, engage into a cross-section taper of an adjacent hollow waveguide.

The second hollow waveguides can in particular have a cross-section taper into which a cross-section widening or an end section of the cross-section of a first hollow waveguide engages. A first hollow waveguide whose cross-section widening or end sections engage at both sides into the cross-section tapers of the second hollow waveguide can particularly preferably be arranged between two second hollow waveguides having cross-section tapers.

The cross-section taper or cross-section widening is preferably respectively provided in a middle region of the hollow waveguide cross-section, in particular in a region that is central with respect to the H field plane.

The hollow waveguides can have the cross-section taper or cross-section widening in the feed section and/or in the transformation section and/or in the opening section.

The long sides of the two hollow waveguides preferably initially run in parallel with one another. Alternatively or additionally, the long sides of the hollow waveguides are perpendicular to one another after the transformation section and in particular after the twist. The long sides of the two hollow waveguides can in particular run in parallel with one another in a feed section and can be perpendicular to one another in an opening section.

In a possible embodiment, the reduction of the cross-section in the transformation section at least comprises a reduction of the short side and/or an increase of the ratio between the long side and the short side.

The horn radiators in accordance with the first and second aspects are each subjects of the present invention independently of one another. A horn radiator in accordance with the disclosure particularly preferably has the features in accordance with the first and second aspects in combination, however.

Preferred embodiments of the present disclosure that can be used both in a horn radiator in accordance with the first aspect and the second aspect will be described in the following:

The horn radiator in accordance with the disclosure is preferably a cellular radio radiator, in particular for a cellular radio base station.

The two hollow waveguides are preferably guided in the direction of the beam to the horn radiator. In a possible embodiment, the two hollow waveguides run next to one another and/or in parallel with one another in the direction of the beam to their openings into the horn radiator.

Within the framework of the present invention, an extent in the direction of the beam preferably means that the hollow waveguide runs at an angle of less than 45°, preferably of less than 30°, further preferably of less than 10°, to a normal at the aperture plane and/or with respect to the main direction of the beam of the horn radiator. The hollow waveguide particularly preferably runs in a direction that is perpendicular to the aperture plane and/or runs in parallel with the main direction of the beam. The main direction of beam is preferably perpendicular to the aperture plane of the horn radiator within the framework of the present invention.

The first and second polarizations are preferably orthogonal to one another. The two hollow waveguides for this purpose preferably have an orthogonal polarization in the region of their openings into the horn radiator. The cross-sections of the two hollow waveguides can in particular be rotated by 90° with respect to one another in the region of the opening.

A section through the hollow waveguide perpendicular to the extent of the hollow waveguide and/or a section in the aperture plane is/are considered a cross-section within the framework of the present disclosure.

In a preferred embodiment of the present disclosure, the opening of one of the hollow waveguides, and in particular of the first hollow waveguide, into the horn radiator has an extent along its long side both in parallel with the aperture plane and perpendicular to the aperture plane. One of the hollow waveguides, and in particular the first hollow waveguide, hereby opens into the horn radiator partly from the side and partly in the direction of the beam. This in turn enables an ideal utilization of the available construction space.

The long side of the opening can here have a first edge region running the aperture plane and a second edge region running perpendicular to the edge region.

The long side of the opening of the hollow waveguide is, however, preferably arranged in a base region of the horn radiator extending at a slant to the aperture plane and/or runs at a slant to the aperture plane. The base of the horn radiator can in particular have a funnel-like region and the opening can be arranged on one side of the funnel-like region.

An outer short side of the opening is here preferably arranged higher than the oppositely disposed inner short side of the opening.

Alternatively or additionally, the extent in parallel with the aperture plane and the extent perpendicular to the aperture plane can have a ratio between 1:1 and 1:8, preferably between 1:2 and 1:5.

In a possible embodiment, the extent in parallel with the aperture plane amounts to between 0.05λ, and 0.4λ, preferably between 0.1λ, and 0.3λ. Alternatively or additionally, the extent perpendicular to the aperture plane can amount to between 0.05λ, and 1.5λ, preferably between 0.4λ, and 1.0λ.

In both cases, λ is the wavelength of a center frequency of a resonant frequency range of the horn radiator, in particular of a lowest resonant frequency range.

In a possible embodiment, one of the hollow waveguides, and in particular the second hollow waveguide, is guided to the horn radiator in the direction of the beam, with its cross-section in projection onto the aperture plane being within the aperture opening.

Alternatively or additionally, the opening of one of the hollow waveguides, and in particular of the second hollow waveguide, into the horn radiator is arranged centrally with respect to the aperture orifice.

Alternatively or additionally, the base of the horn radiator can have a funnel-like region and the opening of one of the hollow waveguides, and in particular of the second hollow waveguide, can be arranged at the tip of the funnel-like region.

The dual polarized horn radiator in accordance with the invention can have material cutouts and/or material insertions in at least one horn region and can in particular have ridges and/or steps and/or dielectrics extending in the vertical direction.

The horn radiator can in particular form a ridge hollow waveguide radiator. The ridge hollow waveguide radiator can be designed without side walls or can have side walls.

The ridges preferably run in the vertical direction. The spacing between the inwardly facing edges of the ridges further preferably increases in the vertical direction. The ridges can in particular have a funnel shape and/or an exponential shape in the vertical direction on their inwardly facing side.

The horn radiator preferably has a resonant frequency range in a range between 10 GHz and 100 GHz, preferably between 25 GHz and 50 GHz, with it preferably being the lowest resonant frequency range.

In a possible embodiment, the maximum diameter of the aperture orifice of the horn radiator amounts to between 0.3λ, and 1.4λ, preferably between 0.5λ, and 1.1λ, further preferably between 0.6λ, and 0.9λ.

In a possible embodiment, the horn radiator has a height between 0.5λ, and 0.4λ, preferably between 1.5λ, and 2.5λ.

In both cases, λ is the wavelength of a center frequency of a resonant frequency range of the horn radiator, in particular of a lowest resonant frequency range.

The horn of the horn radiator in a possible embodiment has a first horn region having side walls substantially extending in the main direction of the beam and a second horn region having side walls flaring in a funnel-like manner, with the height of the second horn region preferably being smaller than the height of the first horn region, and/or with the flaring of the aperture orifice in the second horn region preferably being smaller than 50%, further preferably smaller than 20%. The first and second horn regions can furthermore continuously merge into one another.

Depending on the production method or on the electromechanical demand, complicated shapes can be replaced with simpler shapes in each region. For example, three-dimensional rounded portions present in the transformation region and in the superposition region and in the horn region can be approximated by areas and slanted boundary walls or ramps that are present can be approximated by steps.

In a possible embodiment, the horn radiator has a hexagonal or round aperture orifice and/or base surface.

The present disclosure furthermore comprises a radiator array composed of a plurality of dual polarized horn radiators arranged in a column or row next to one another, with each of the horn radiators being fed by a first and a second hollow waveguide. Provision is made in accordance with a first aspect that the hollow waveguides of a column or row are each guided in the direction of the beam to their openings into the horn radiators, with every second hollow waveguide in the column or row having a transformation section by which its polarization in the aperture plane is rotated before it opens into the horn radiator. Provision is made in accordance with a second aspect of the present invention that a respective hollow waveguide, and in particular the first hollow waveguide, of a horn radiator runs in the direction of the beam to its opening into the horn radiator and in so doing its cross-section extends in projection onto the aperture plane at least partly below the aperture orifice of an adjacent horn radiator.

The radiator array is preferably a cellular radio antenna, in particular for a cellular radio base station.

In a preferred embodiment, the single radiator distance in the column and/or row amounts to less than 1λ, preferably less than 0.85λ, further preferably less than 0.75λ, and further preferably less than 0.5λ.

In a possible embodiment, the horn radiators are arranged in a plurality of columns and/or rows arranged next to one another and the sum of the single radiator distance in the column or row and the single radiator distance perpendicular to the column or row amounts to less than 2λ, preferably less than 1.7λ, and further preferably less than 1.5λ.

In both cases, λ is the wavelength of the center frequency of a resonant frequency range of the radiator array and in particular of the lowest resonant frequency range.

The radiator array preferably comprises a plurality of dual polarized horn radiators arranged next to one another, as were shown in more detail above. Alternatively or additionally, individual horn radiators, a plurality of horn radiators, or all the horn radiators of the radiator array can have one or more features that have been described above with respect to the horn radiator in accordance with the invention.

In a possible embodiment of the radiator array, the horn radiators are arranged in a plurality of columns arranged next to one another or in a plurality of rows arranged next to one another, with the horn radiators of adjacent columns or rows preferably being arranged offset from one another, with the horn radiators preferably being arranged in a honeycombed form.

In a possible embodiment, the radiator array has a feed network.

The first hollow waveguides and the second hollow waveguides of the horn radiators arranged in a column or row preferably have a bend toward the side at different vertical planes of the feed network.

The respective first hollow waveguides of the horn radiators arranged in a column or row and/or the second hollow waveguides of the horn radiators arranged in a column or row have a bend toward the side at the same vertical plane.

Alternatively or additionally, the hollow waveguides of horn radiators arranged in two adjacent rows or columns have a bend toward the side in different vertical planes.

In a possible embodiment, the hollow waveguides of the horn radiators are each individually fed.

In an alternative embodiment, the first hollow waveguides of the horn radiators arranged in a column or row and/or the second hollow waveguides of the horn radiators arranged in a column or row are connected by a distributor having a common feed.

The present invention further comprises group antennas comprising a plurality of subarrays that are configured such as was described above.

The present invention further comprises a cellular radio base station having one or more horn radiators such as have been described above and/or one or more radiator arrays such as have been described above.

BRIEF DESCRIPTION OF THE FIGURES

The present invention will now be described in more detail with reference to embodiments and to drawings.

There are shown.

DETAILED DESCRIPTION

Figure 1:
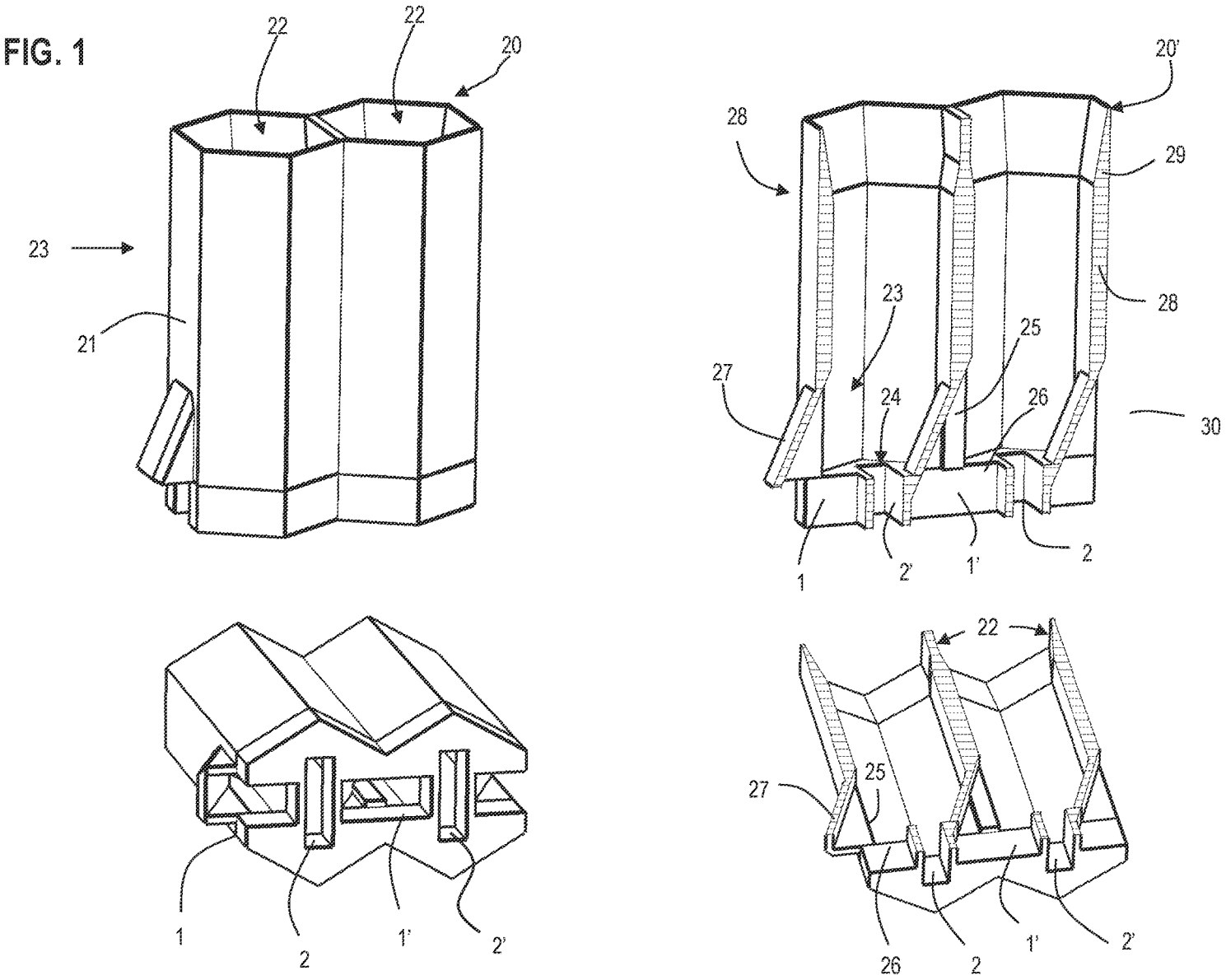
FIG. 1: an embodiment of a horn radiator and of a radiator array in accordance with the first aspect.

FIG. 1 shows an embodiment of two dual polarized horn radiators 20 and 20' in accordance with the first aspect of the present invention. The two radiators thus simultaneously form an embodiment for a radiator array in accordance with the invention.

The two horn radiators 20 and 20' each have a horn, i.e. a hollow body open in the main direction of the beam, via which electromagnetic waves can be radiated and received. The feed of the horn takes place by hollow waveguides of which only the end region is shown in FIG. 1.

The horn radiators 20 and 20' in the embodiment have two orthogonal polarizations that are fed by two separate hollow waveguides 1 and 2 that open via orifices 23 and 24 into the horn of the respective horn radiators 20 and 20'. The polarizations of the two hollow waveguides or of the electromagnetic waves guided by the hollow waveguides are each perpendicular to one another in the region of the opening of the hollow waveguides into the horn radiator.

The first hollow waveguide 1 or 1' respectively is guided in accordance with the first aspect of the present invention from the bottom to the top, i.e. in the direction of the beam to the horn radiator, with its cross-section only partly overlapping with the aperture orifice 22 of the horn radiator 20 or 20' that it supplies with signals and being partly located outside the aperture orifice. The hollow waveguides 1 and 1' here preferably run in the main direction of beam and/or perpendicular to the aperture plane.

As shown at the top right in the sectional view in FIG. 1, the first hollow waveguide 1' that supplies the horn radiator 20' with signals is therefore partly located below the aperture orifice 22 of this horn radiator 20' and partly below the aperture orifice 22 of the adjacent horn radiator 20. The cross-section of the hollow waveguide 1' in a projection onto the aperture plane thus overlaps in part with the aperture orifice of its own radiator and partly with the aperture orifice of an adjacent radiator.

A very compact arrangement is hereby achieved since the space below the adjacent horn radiator can be used to supply the signals to a horn radiator.

In the embodiment, the feed of the horn radiator takes place via the first hollow waveguide 1 or 1', partly laterally and partly from below here. For this purpose the part of the cross-section of the first hollow waveguide that runs below the aperture orifice of the respective radiator is in particular extended into the radiator. The region of the cross-section that runs outside the aperture orifice and in particular in the region of the aperture orifice of the adjacent radiator is in contrast laterally guided into the horn radiator.

In the embodiment, the first hollow waveguide 1 has a boundary wall 27 that extends from a position outside the aperture orifice of the horn radiator obliquely upwardly to the opening 23 into the horn radiator. In the embodiment, the boundary wall 27 is the wall of a short side of the first hollow waveguide. The boundary wall 27 here simultaneously forms a base region of the adjacent horn radiator.

The opening 23 of the first hollow waveguide 1 thus has both an extent exemplified by vertical edge 25 in a direction normal to the aperture plane and an extent exemplified by horizontal edge 26 within the aperture plane. In the embodiment, the orifice 23 for this purpose has a kink, i.e. the orifice is bounded by a vertical edge 25 and a horizontal edge 26. In alternative embodiments, the opening 23 can, however, also have an edge running obliquely to the aperture plane.

The orifice 24 at which the second hollow waveguide opens into the horn radiator is in contrast located completely within the aperture orifice and the base region of the respective horn radiator. In the embodiment, the orifice 24 is here arranged centrally with respect to the aperture orifice of the respective horn radiator.

The horn radiators in the embodiment thus have a respective superposition region 30 in which the superposition of the two polarizations takes place and which is formed by the base of the horn and by a wall region of the horn extending up to the upper end of the opening 23 of the hollow waveguide.

In the embodiment, a lower horn region 28 follows thereon in which the horn extends substantially vertically upwardly, i.e. in the main direction of the beam and/or perpendicular to the aperture plane, and an upper horn region 29 in which the horn widens outwardly.

Only two horn radiators in accordance with the invention are shown by way of example in FIG. 1. However, more than two such radiators can naturally also be arranged next to one another in a row or column. The horn radiators in the embodiment thus each have a hexagonal base shape so that a honeycombed arrangement of a plurality of columns and rows next to one another is possible.

Further details and variants with respect to the embodiment of a horn radiator or of a radiator array in accordance with the first aspect of the present invention will be described in the following with even more detail with reference to FIGS. 6-21.

Figure 2:
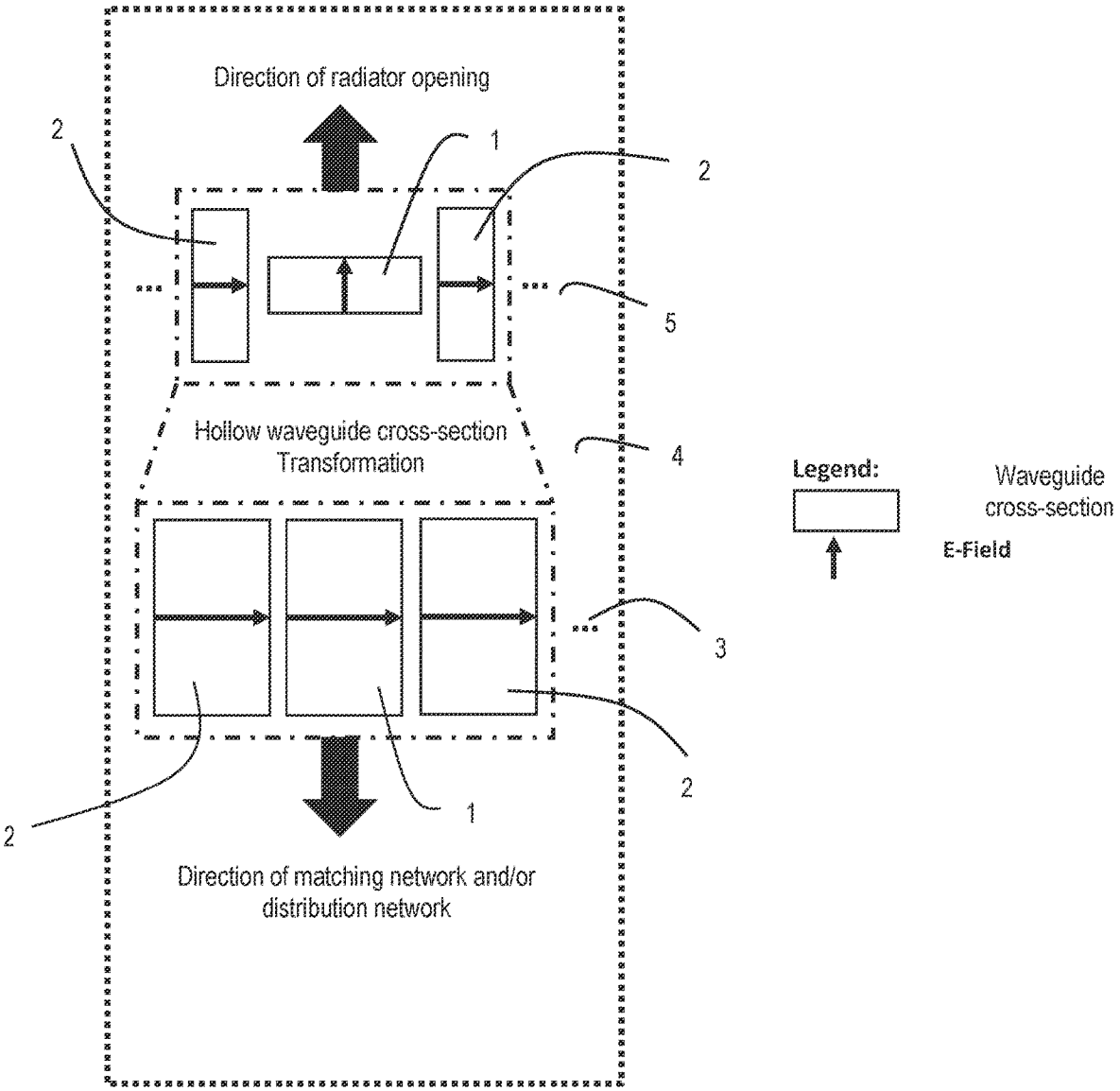
FIG. 2: a schematic diagram of the hollow waveguides of a horn radiator or of a radiator array in accordance with the second aspect.

FIG. 2 shows the underlying idea of a dual polarized horn radiator or a corresponding radiator array in accordance with the second aspect of the present invention. The feed of the two polarizations also takes place via separate hollow waveguides 1 and 2 here.

The hollow waveguides are guided in parallel with one another in a feed section 3 by which they are connected to a feed network and have the same orientation of the polarization there. The E field is respectively shown schematically as an arrow in FIG. 2. In an opening region 5 at which the hollow waveguides open into the respective horn radiators, the polarizations in contrast have different orientations for the first and second hollow waveguides. The polarizations are in particular perpendicular to one another. A transformation section that serves for field transformation and/or impedance transformation is provided for this purpose between the feed section 3 and the opening section 5. In this respect, the first hollow waveguide in particular has a twist in the transformation section by which its polarization is rotated with respect to the other hollow waveguide.

The hollow waveguides 1 and 2 are guided from the feed section 3 via the transformation section 4 up to the opening section 5 in each case in parallel from the bottom to the top, i.e. in the direction of the beam and in particular perpendicular to the aperture plane so that due to the twist in the region of the transformation section of the hollow waveguide 1 a rotation of its polarization in the aperture plane or about an axis of rotation perpendicular to the aperture plane takes place. The second hollow waveguide in contrast has not twist in the transformation section 4 so that its polarization does not rotate.

This arrangement has the advantage that the available space can be ideally used in the region of the feed section 3 that is connected to a matching network and/or to a distribution network. The first and second hollow waveguides can in particular be identically aligned in this region and/or can have an identical cross-section and thus ideally use the space present. The hollow waveguides are thus first aligned orthogonally to one another in the region of the opening section 5 and thus only require corresponding space there.

To have sufficient space for the hollow waveguides oriented in a rotated manner with respect to one another in the region of the opening, the area of the hollow waveguide cross-section reduces in the direction toward the horn radiator in the transformation section. This is preferably the case both for the first hollow waveguide and for the second hollow waveguide. The area of the hollow waveguide cross-section is thus in particular smaller in the direction of the antenna than the area of the hollow waveguide cross-section in the direction of the distribution network. The hollow waveguides therefore have a higher wave impedance and a higher lower cut-off frequency in the antenna direction than in the distribution network direction.

The transformation section having the hollow waveguide cross-section change for the field transformation and impedance transformation has the advantage that orthogonally polarized radiator openings on the antenna side can be compactly interlaced, while a larger, broader band and lower loss standard hollow waveguide can be used on the side of the matching network and/or distribution network.

The matching network and/or distribution network can thus be configured as broadband, for example. A WR28 hollow waveguide could, for example, be used for the range between 26.5 GHz to 40.0 GHz. The antenna side, i.e., on the one hand, the transformation section and the horn radiator, can in contrast be configured with a narrower band and as replaceable. For example, respective different transformation sections and different horn radiators can be used for two different frequency ranges in the larger frequency range of the matching network and/or distribution network. A first horn radiator type could, for example, be used for the frequency range between 27 GHz and 29 GHz, on the one hand, and a second horn radiator type could be used for the frequency range between 37 GHz and 39 GHz, on the other hand. The total system can hereby be given a modular design and the matching network and/or distribution network can in particular be used for different applications.

Figure 3:
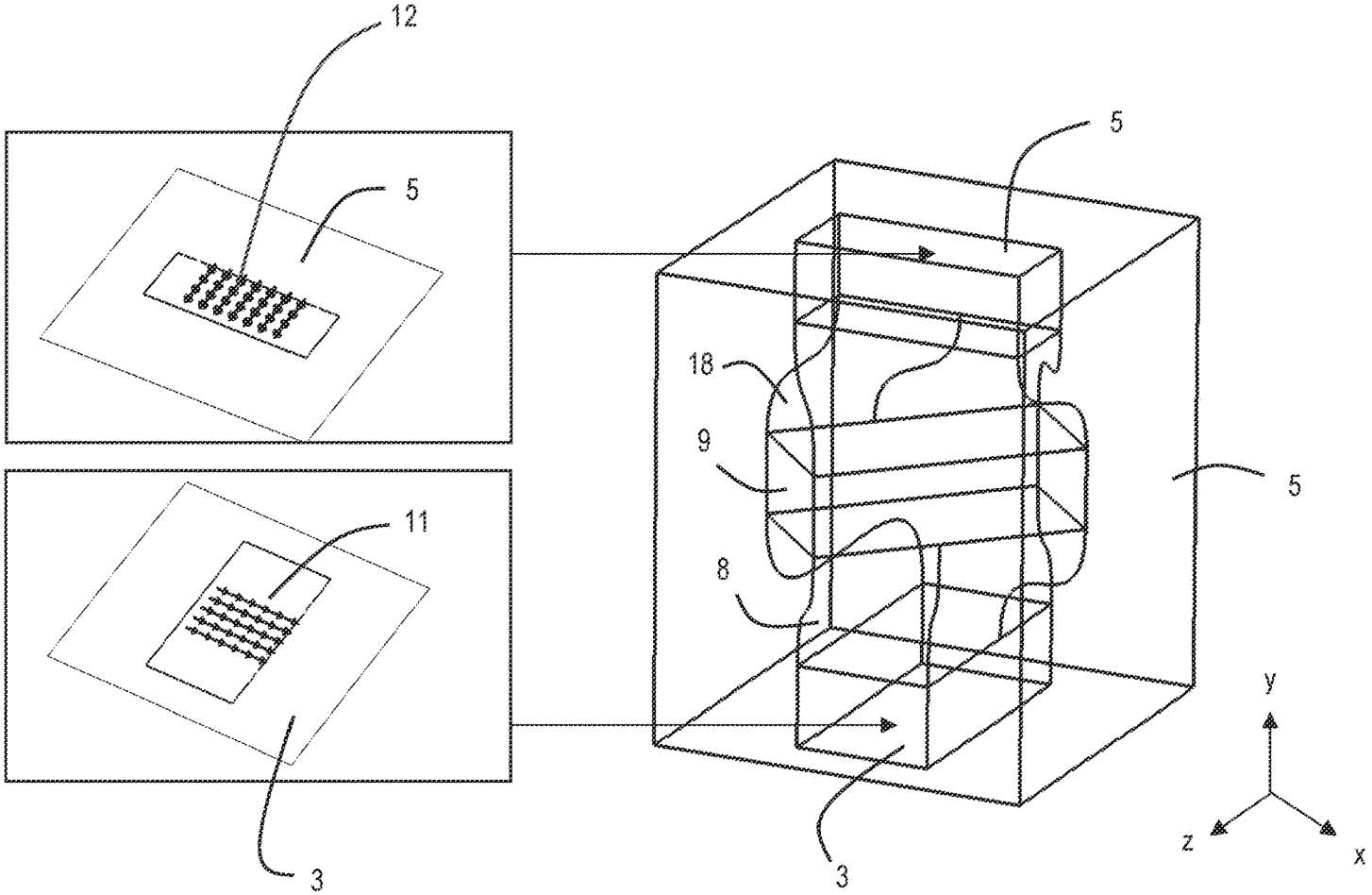
FIG. 3: an embodiment of a transformation section for a horn radiator in accordance with the second aspect with two diagrams that show the progression of the E field at the start and end of the transformation section.

FIG. 3 now shows a possible embodiment for a transformation section 4 for the first hollow waveguide. In this respect, a hollow waveguide cross-section that is polarized in the x direction and that is connected to the feed section 3 is transformed to a hollow waveguide section that is polarized in the z direction and that is connected to the opening section 5. At the same time, the cross-sectional area is reduced, in the embodiment, for example, from a hollow waveguide cross-section of 7.11 mm×3.55 mm and 572 ohm wave impedance to a hollow waveguide cross-section of 6.11 mm×2.4 mm and approximately 785 ohm wave impedance.

In general, the shape of the transformation section can be any desired between its two ends. Three-dimensional rounded portions can in particular be replaced in part or in full with areas or steps or the transformation section can be produced from two or more individual parts and can be joined together depending on the production method. In the embodiment shown in FIG. 3, the transformation section 4 comprises two transformation elements 8 and 11, that respectively rotate the field by 45°, and an interposed intermediate element 9 having a constant cross-section. It is, however, also conceivable to rotate one or more elements having a constant cross-section by any desired angle, i.e. to carry out a multi-stage transformation, or not to use any intermediate element and to connect the two sides by a continuous twist. It is only decisive that the polarization, as shown at the left in FIG. 3, was rotated between the inlet 3 and the outlet 5 and the cross-section was reduced. The E field is drawn at 11 in FIG. 3 in the region of the feed section 3 and at 12 in the region of the opening section 5.

FIG. 3 shows a transformation section for the first hollow waveguide in which a rotation of the polarization takes place. In the embodiment shown in FIG. 2, the second hollow waveguide in contrast does not have any twist, but rather only experiences a cross-section taper in the region of the transformation section. This serves to provide sufficient space for the arrangement of the hollow waveguides orthogonal to one another in the opening region.

Figure 4:
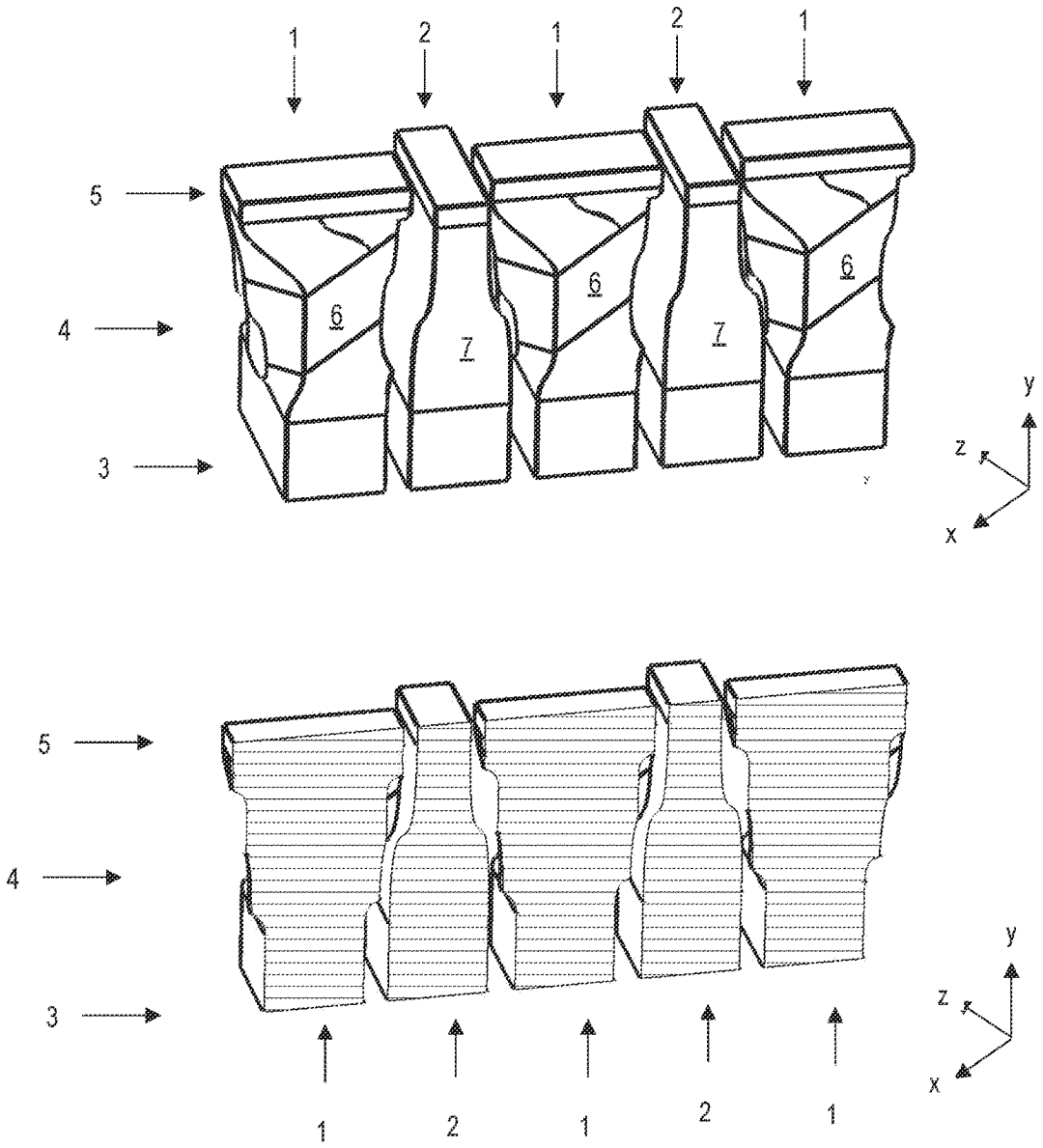
FIG. 4: a specific embodiment of the hollow waveguides of a horn radiator or of a radiator array in accordance with the second aspect in a perspective representation and in a sectional view.

This is illustrated again with reference to FIG. 4 that shows the transformation sections 6 and 7 of first and second hollow waveguides 1 and 2 arranged next to one another in a column. The transformation sections 6 of the first hollow waveguides 1 here have a twist and a cross-section taper; the transformation sections 7 of the second hollow waveguides 2 in contrast have only a cross-section taper. The space that is required to enable the twist of the first hollow waveguides 1 is produced by the cross-section taper of the transformation sections 7 of the second hollow waveguides.

In the embodiment, hollow waveguides are used having a longer side and a shorter side. In the feed section 3, the longer sides of the first and second hollow waveguides are each arranged adjacent to and in parallel with one another. Now, however, due to the twist of the first hollow waveguides in the transformation section 4, the longer sides of the first and second hollow waveguides are each perpendicular to the other in the opening section 5.

While therefore only space for the shorter sides of the first hollow waveguides is required between the long sides of two second hollow waveguides in the feed section 3, space is in contrast required for the longer side of a first hollow waveguide in the opening region 5. To provide this space, the shorter sides of the second hollow waveguides are in particular further shortened. The longer sides of the first hollow waveguides can furthermore also be shortened.

A shortening of both the longer sides and the shorter sides of the first and second hollow waveguides therefore takes place here in the embodiment, but with the ratio between the longer and shorter sides being increased, i.e. the shorter sides are shortened more percentage-wise than the longer sides. The hollow waveguide hereby admittedly becomes more narrow band. The cut-off frequency is, however, not increased to the same degree.

In accordance with the invention, a cross-section having a greater extent in the H field plane than in the E field plane is preferred for the simply polarized waveguides used here. The hollow waveguides in particular have a ratio between the longer sides and the shorter sides of more than 1.5:1 and less than 2.5:1 on the side of the feed network and/or distribution network and in particular in the feed section. The ratio between the longer and shorter sides in the opening section is preferably larger than in the feed section, in particular more than 2.5:1 and further preferably more than 3:1. A good compromise between compactness and electrical properties is hereby achieved.

A hollow waveguide having a rectangular cross-section can in particular be used in accordance with the invention. The TE10(H10) mode is excited in this case.

However, hollow waveguides having at least one cross-section constriction and/or at least one cross-section widening in the E-field plane and/or H field plane are also conceivable. Hollow waveguide variants having at least one cross-section constriction in the H field plane, so-called ridge hollow wave guides, can in particular be used. In this case, the TE10 mode and/or a higher mode is preferably likewise excited.

Figure 5:
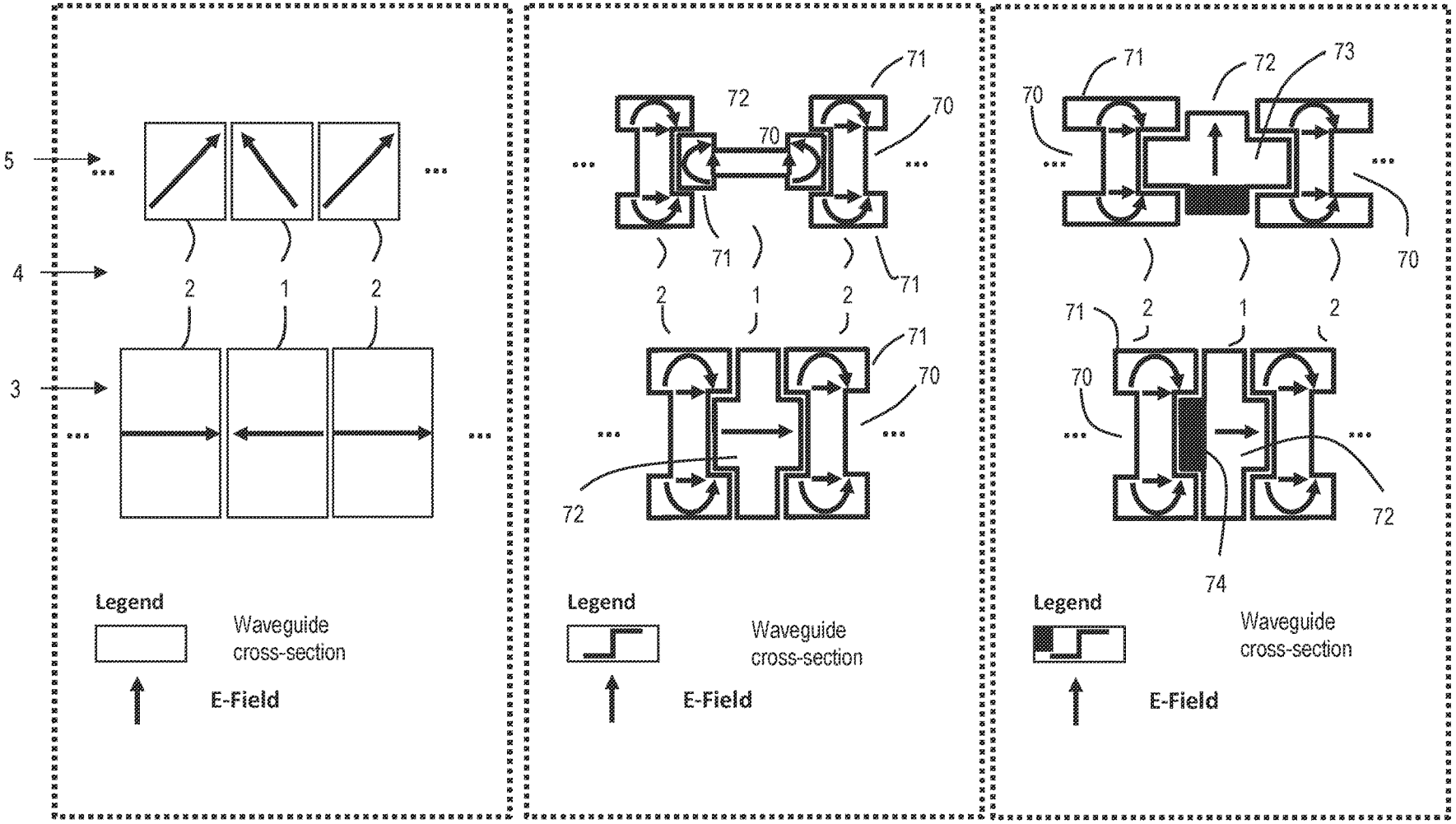
FIG. 5: schematic diagrams of three variants of hollow waveguides for a horn radiator in accordance with the second aspect.

Three variants for the transformation section in accordance with the second aspect of the present invention are shown in FIG. 5.

The hollow waveguides in the variant shown on the left here already have a different polarization in the region of the feed section 3. Furthermore, in the variant on the left, the polarizations of both the first hollow waveguide 1 and of the second waveguide 2 are rotated in the transformation section. In this respect, the first and second hollow waveguides in the feed section 3 each have oppositely oriented polarizations. They are each rotated by 45 degrees by corresponding transformation sections 4 so that they are orthogonal to one another in the opening section.

In addition, hollow waveguides having a substantially square waveguide cross-section are used in the opening section 5. They are used as simply polarized 45° waveguides in which the polarization thus runs diagonally.

In the embodiments in the middle and on the right, the hollow waveguides 1 and 2 at least have different cross-section shapes in the feed section 3. The polarizations of the hollow waveguides 1 and 2 are in contrast still oriented in the same direction in the feed section 3.

An embodiment is shown in the middle of FIG. 5 here in which the first hollow waveguide 1 in the feed section 3 has a partly widened rectangular hollow waveguide cross-section and in the opening section 5 has a partly narrowed rectangular hollow waveguide cross-section in the H plane. In the feed section 3, the first hollow waveguide has a cross-section widening 72 in the region in the middle with respect to the H plane and in the opening section 5, has a cross-section taper 70 in a region in the middle with respect to the now rotated H plane.

The second hollow waveguide 2 has a partly constricted rectangular hollow waveguide cross-section in the H plane in the feed section 3 and in the opening section 5. The second hollow waveguide 2 in particular respectively has a cross-section taper 70 in a region in the middle with respect to the H plane.

This improves the mode selectivity and/or bandwidth of the hollow waveguide and/or produces a more compact design and can also be used in the other embodiments. In this case, the hollow waveguide 2 has the field characteristic of a double-ridge hollow waveguide.

The polarization of the first hollow waveguide 1 is rotated by 90 degrees by the transformation section 4 and its cross-sectional shape and field distribution are changed so that orthogonal polarizations having a similar field distribution result in the opening region 5. In turn respective waveguide cross-sections are used in the opening region that have a considerably larger extent in the H field plane than in the E field plane.

Furthermore, the cross-sectional areas of the hollow waveguides both in the feed section 3 and in the opening section 5 are interlaced with one another in that a cross-section widening 72 or an end section 71 of the one hollow waveguide engages into a cross-section taper 70 of the other hollow waveguide.

The embodiment on the right in FIG. 5 shows a particularly compact variant. The first hollow waveguide 1 has a partly widened and a partly filled rectangular hollow waveguide cross-section in the H plane with a cross-section widening 72 in a region in the middle with respect to the H plane in the feed section 3 and in the opening section 5. The polarization of the hollow waveguide 1 and its cross-sectional area is reduced by the transformation section 4. The cross-sectional shape and the field distribution are, however, substantially maintained.

The second hollow waveguide 2 in turn has a partly constricted rectangular hollow waveguide cross-section in the H plane in the feed section 3 and in the opening section 5. The second hollow waveguide 2 in particular respectively has a cross-section taper 70 in a region in the middle with respect to the H plane. The ratio between the width of the cross-section in the E-field plane in the wider end regions 71 and the cross-section taper 70 furthermore increases between the feed section 3 and the opening section 5.

The hollow waveguide 1 and the hollow waveguide 2 in the opening section 5 thereby have orthogonal polarizations and different field distributions and/or field distribution densities, which can result in a better decoupling and a more compact design depending on the embodiment of the superposition region 30.

A very compact arrangement furthermore results since in the feed section 3 the cross-section widening 72 of the first hollow waveguide 1 engages into the cross-section tapers 70 of the adjacent second hollow waveguides 2 while in the opening section 5 the narrower end regions 73 of the cross-section of the first hollow waveguide 2 now rotated by 90° engage into the now deeper cross-section tapers 70 of the adjacent second hollow waveguides 2.

In general, the hollow waveguides can have ridges, material fillings, material cutouts, cross-section widenings, cross-section constrictions, and many further measures to reduce costs and/or to reduce size and/or to improve the electrical and mechanical properties.

Both aspects of the present invention are preferably implemented, i.e. the first polarization is guided centrally between two radiator orifices to the radiator and is rotated via a transformation section. A hollow waveguide cross-sectional change by which the wave impedance is changed is further preferably provided in the transformation section.

The polarization rotation is preferably implemented via a hollow waveguide twist, in particular via a hollow waveguide twist about an axis of rotation that is normal to the aperture plane. At the same time, a reduction of the hollow waveguide cross-section takes place in a direction normal to the aperture plane within the hollow waveguide twist, which results in a wave impedance change and more compact dimensioning. The rotated radiator opening is preferably guided at least partly laterally into the radiator.

Figure 6:
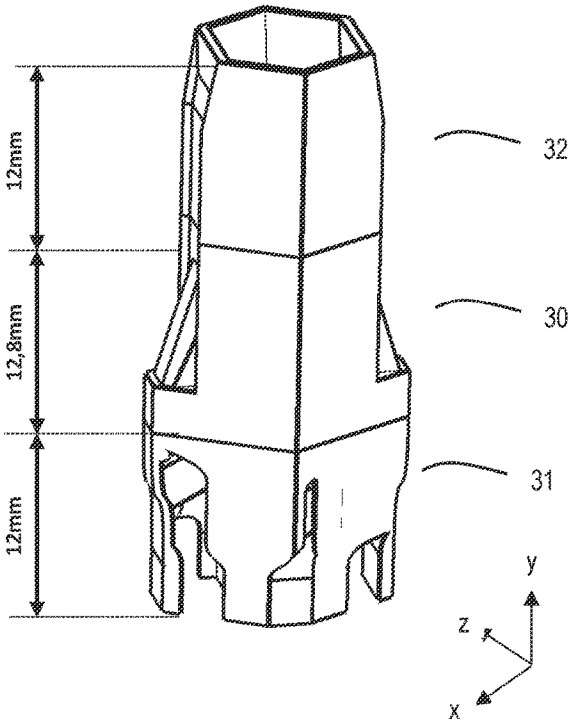
FIG. 6: an embodiment of a horn radiator and of a radiator array in which the first and second aspects of the present invention are implemented in combination.
Figure 6:
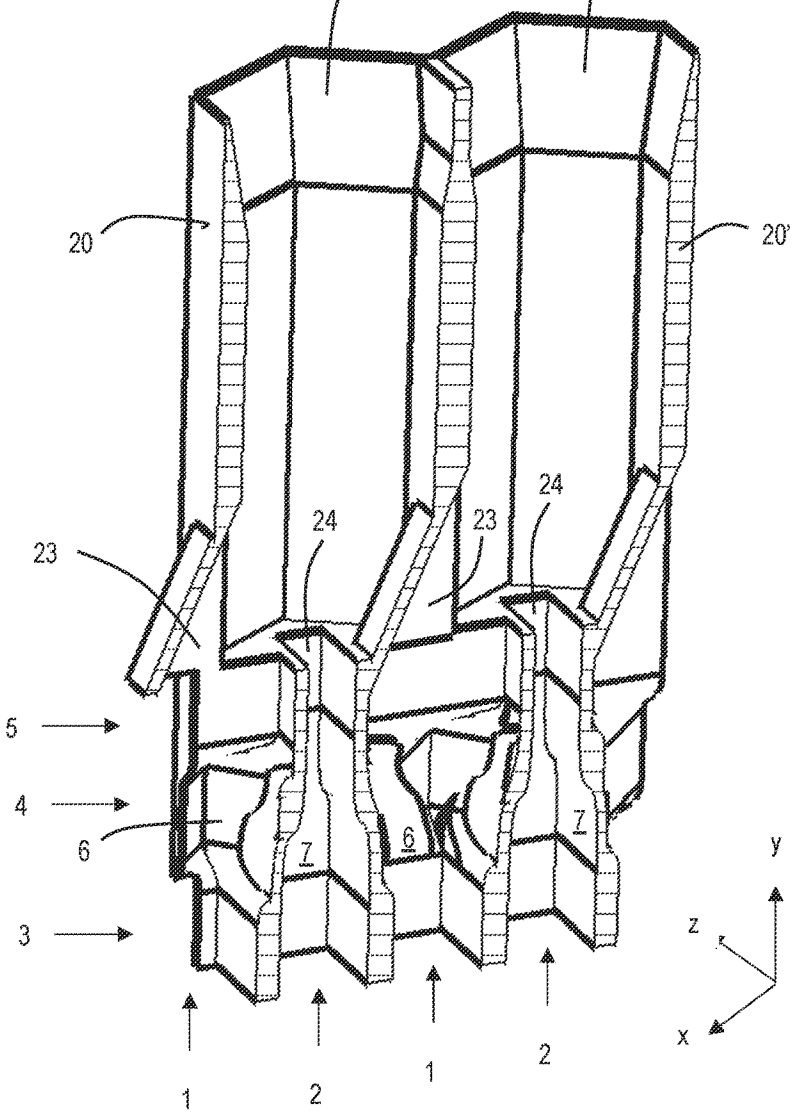

FIG. 6 now shows a corresponding embodiment in which the feed of the horn radiators in accordance with the first aspect takes place such as has already been shown above with respect to FIG. 1. The transformation of the hollow waveguides takes place as has been shown above with respect to the embodiment in FIGS. 2 to 4. The opening sections 5 of the first and second hollow waveguides described above in particular with respect to the second aspect are connected to the orifices 23 or 24 via which the horn radiators in accordance with the first aspect of the present invention are fed.

As can be seen from FIG. 6, the combination of the first and second aspects has a very substantial synergistic potential. For by the combination of the first and second aspects, it is possible to allow the second hollow waveguides 2 to open centrally into the horn radiator with respect to the aperture orifice 22 of the horn radiators 20 or 20'. The space available between the openings of the second hollow guides is nevertheless ideally utilized by the rotated opening regions of the first hollow waveguides 1 since this opening region is not restricted to the space available below the respective aperture orifice, but rather extends below the respective aperture orifice of the adjacent radiator.

A possible dimensioning of a horn radiator in accordance with the invention is shown at the right in FIG. 6. The transformation region 31 can here, for example, have a height H1 of 0.5-1.5λ; the superposition region 30 used to superpose the polarizations within the horn radiator can have a height H2 of 0.5-1.5λ, and the actual horn 32 can have a height H3 between 0.5λ and 4λ.

A possible dimensioning for the aperture opening is indicated again at the left in FIG. 7. The maximum diameter Di at the level of the lower horn section 28 in which the walls of the horn extend substantially vertically upwards, i.e. in the main direction of the beam, can here, for example be at 0.8λ+/−0.3λ. The maximum diameter Da of the aperture orifice 22, i.e. after the widening of the upper horn region 29, can be disposed, for example, at 1.1λ+/−0.3λ.

λ is in each case the wavelength of the center frequency of the lowest resonant frequency range of the radiator in accordance with the invention.

Figure 7A:
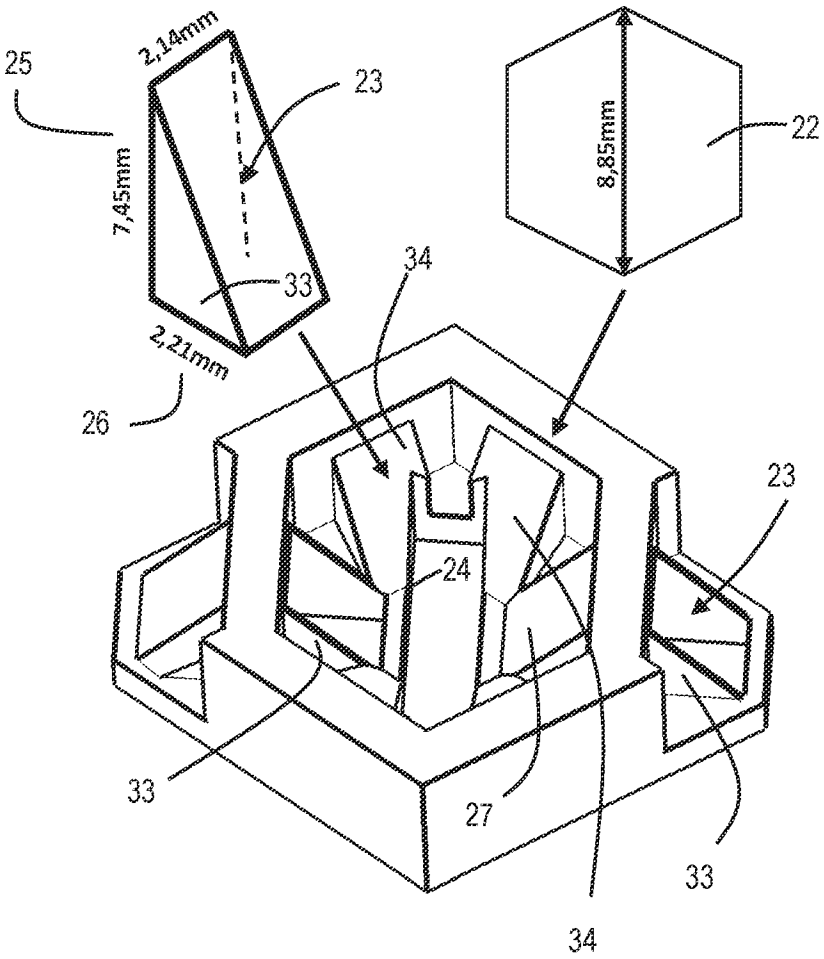
FIG. 7A: a variant of the superposition region of the two polarizations in a horn radiator in accordance with the first and second aspects of the present invention.
Figure 7A:
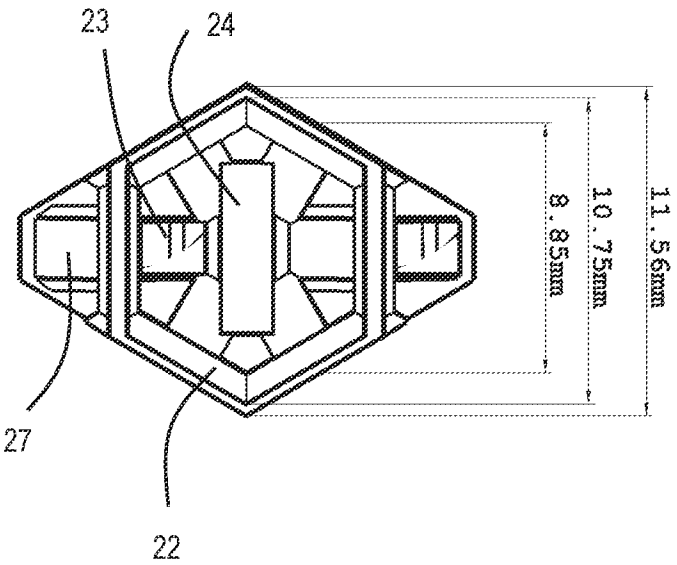

An alternative embodiment of the superposition region of the two polarizations is shown on the right in FIG. 7A. The orifice 23 here has longer sides that run obliquely to the aperture plane and that connect the upper and lower narrow sides to one another. In the embodiment, the orifice for this purpose has triangular side walls 33 that extend along the longer sides.

Wedge elements 34 are furthermore provided in the base region of the horn that extend from the inside to the side walls. They preferably have the same shape as the boundary walls 27 for the opening region of the adjacent first hollow waveguide. The base region hereby has a funnel shape overall. The opening 24 for the second hollow waveguide is arranged at the center of the funnel and intersects the ramps of the wedge elements 34 in the embodiment.

A possible dimensioning of the opening 23 for the first radiator is indicated at the right in FIG. 7A. The orifice 23 can here have an extent B1 in the direction of its shorter side of 0.2λ+/−0.2λ. The extent in the vertical direction B3 can be at 0.7λ+/−0.7λ; the extent in the aperture plane B4 at 0.2λ+/−0.2λ.

Figure 7B:
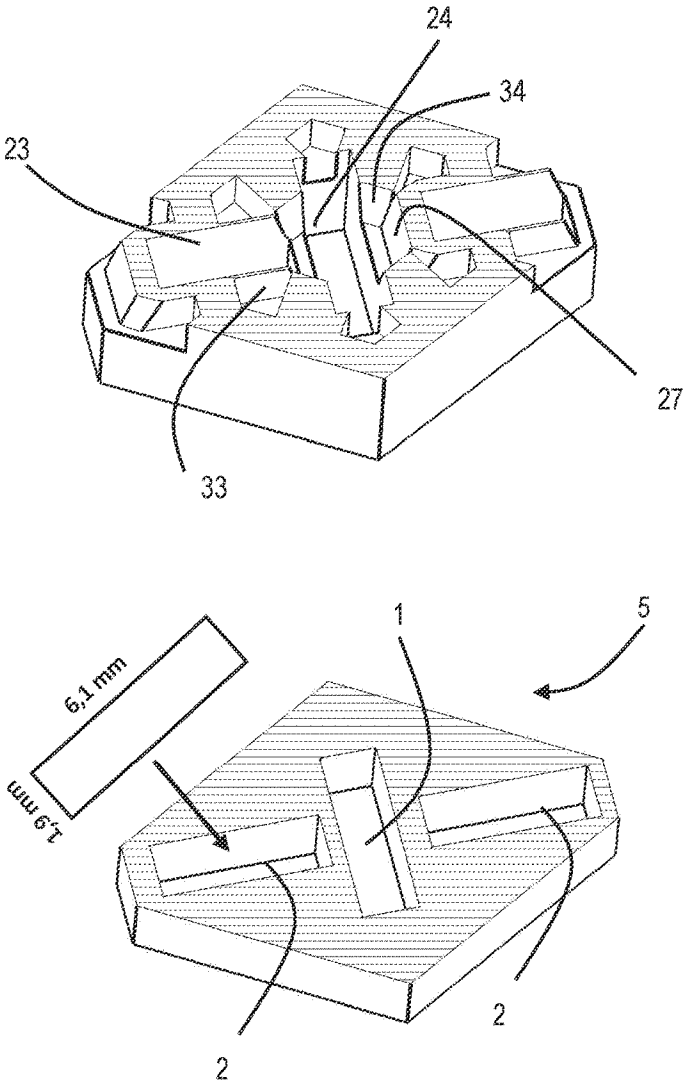
FIG. 7B: a plurality of sectional views at different levels for the embodiment shown in FIG. 7A.
Figure 7B:
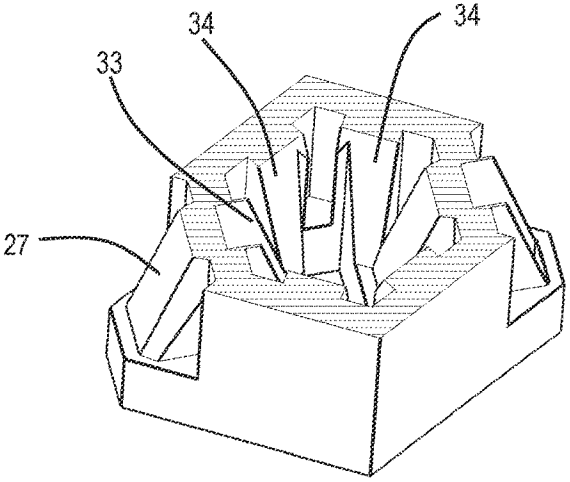

Three sections in parallel with the aperture plane are again shown in FIG. 7B for the embodiment shown in FIG. 7A. A section through the opening region 5 is shown at the bottom right, i.e. just below the connection to the orifices of the horn radiator.

A possible dimensioning for the hollow waveguides in the opening region is shown in FIG. 7B. The narrow side can here in particular have a width B1 of 0.2λ+/−0.2λ, and the longer side can have a width B2 of more than 0.5λ, for example of 0.55λ.

With a normal rectangular hollow waveguide, the longer side should not fall below a length of 0.5λ, with respect to the cut-off frequency. However, smaller dimensions and/or higher bandwidths are possible by the use of ridge hollow waveguides and/or hollow waveguides filled with a dielectric. One or more ridges can here, for example, be arranged centrally in the hollow waveguides to increase the bandwidth and/or to reduce the cut-off frequency.

λ is here again with all the dimensions given here the center frequency of the lowest resonant frequency range of the horn radiator in accordance with the invention.

The configuration of the superposition region can also adopt more complex shapes in dependence on the hollow waveguide cross-section. With double ridge hollow waveguides, the wedge segments 34 can, for example, have material cutouts and/or a ramp shape, in particular a ramp shape having an exponential extent.

Figure 8:
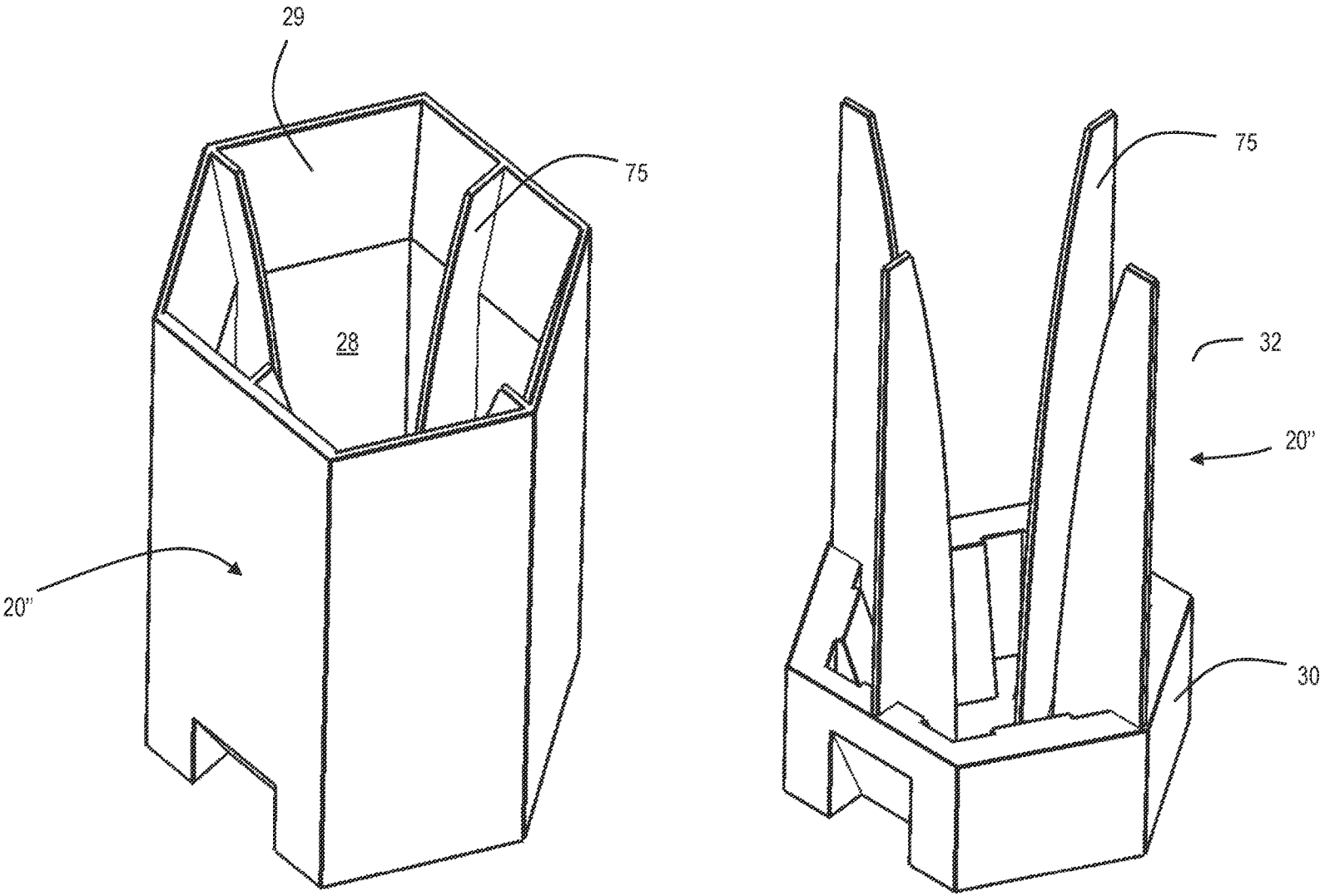
FIG. 8: two further embodiments of a horn radiator in accordance with the invention that is configured as a ridge hollow space radiator with or without side walls.

The radiator can furthermore, as shown in FIG. 8, be configured as a ridge hollow waveguide antenna. A ridge hollow waveguide antenna 20" having side walls is shown on the left here; a ridge hollow waveguide antenna 20'" without side walls is shown on the right. The horn of the ridge hollow waveguide antenna 20" has the same configuration that was described in more detail above with respect to FIGS. 1 and 6. The ridge hollow waveguide antenna 20'" in contrast only has the above-described superposition region 30, while only the ridges extend into the region of the actual horn and the side walls are missing there.

The ridge hollow waveguide antenna has respective ridges 75 that extend in the vertical direction. The ridges 75 in the embodiment extend, starting from the transition region 30, into the actual horn 32.

The ridges are of plate shape. The plate plane of the ridges 75 extends in each case radially to the center axis of the radiator and/or is perpendicular to the side wall along which it extends. The inner edges of the ridges have a distance that increases toward the radiator orifice.

The ridges 75 extend along the inner walls of the horn on the left in the embodiment. They extend over the regions 28 and 29 up to the radiator opening on the left in the embodiment.

Simpler shapes are, however, also conceivable depending on the demand and on the production method.

Figure 9:
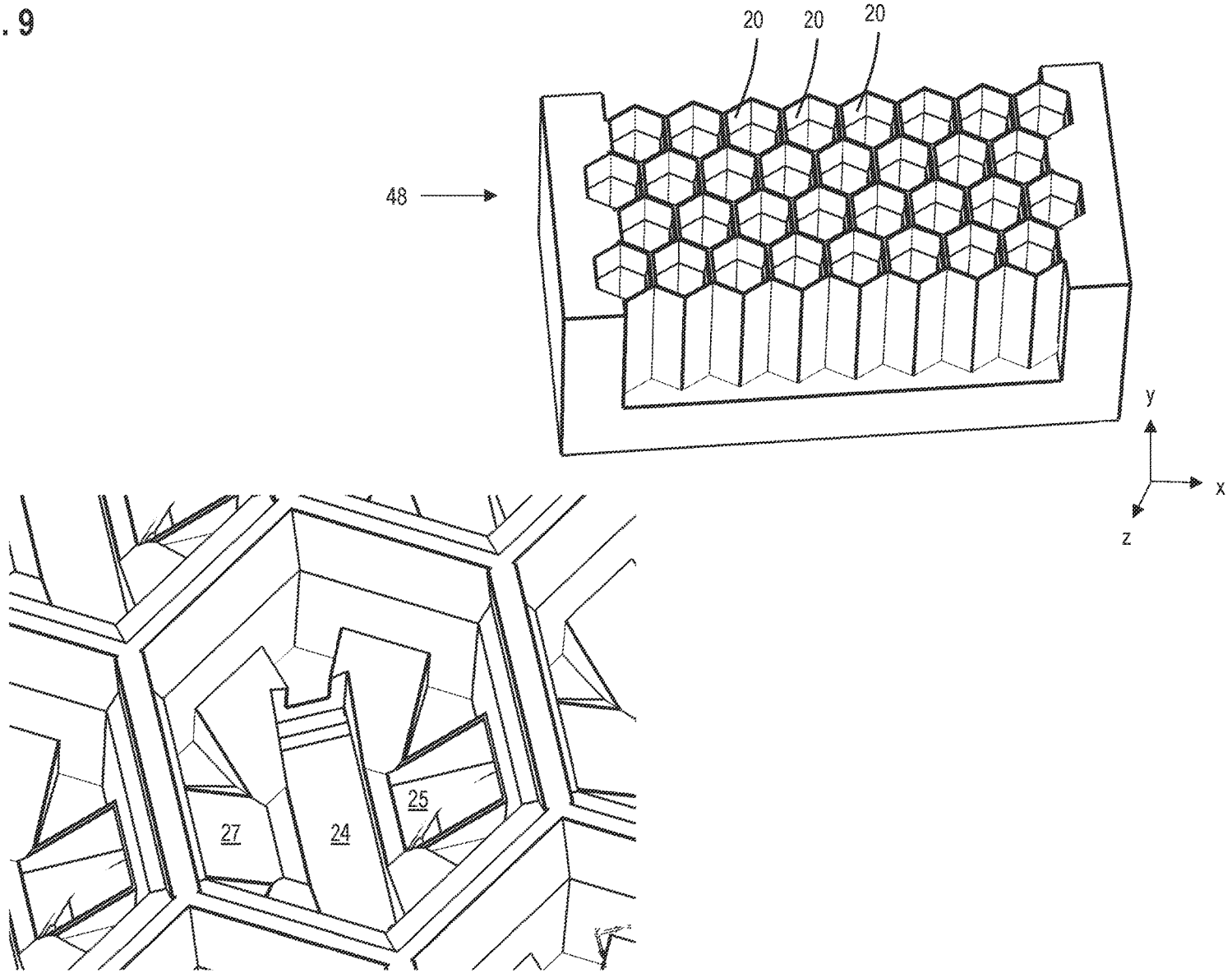
FIG. 9: an embodiment of a radiator array in accordance with the invention with a detail view of one of the horn radiators used in a perspective from above.

FIG. 9 now shows an embodiment of the radiator array that comprises four columns with eight individual radiators 20 each. The individual radiators are here configured in each case such as is shown in FIGS. 6 and 7. The corresponding embodiment of the superposition region in the base region of the horn radiators is here shown again in section on the left in FIG. 9. The group antenna shown in FIG. 9 can, for example, be an antenna having a center frequency of 28 GHz and 2 GHz bandwidth.

The column distance, i.e. the individual radiator distance in the z direction, amounts to 8.5 mm, i.e. 0.80λ, at 28 GHz, in the embodiment. The line distance, i.e. the individual radiator distance in the x direction, amounts to 9.0 mm, i.e. 0.84λ, GHz, in the embodiment.

Figure 10:
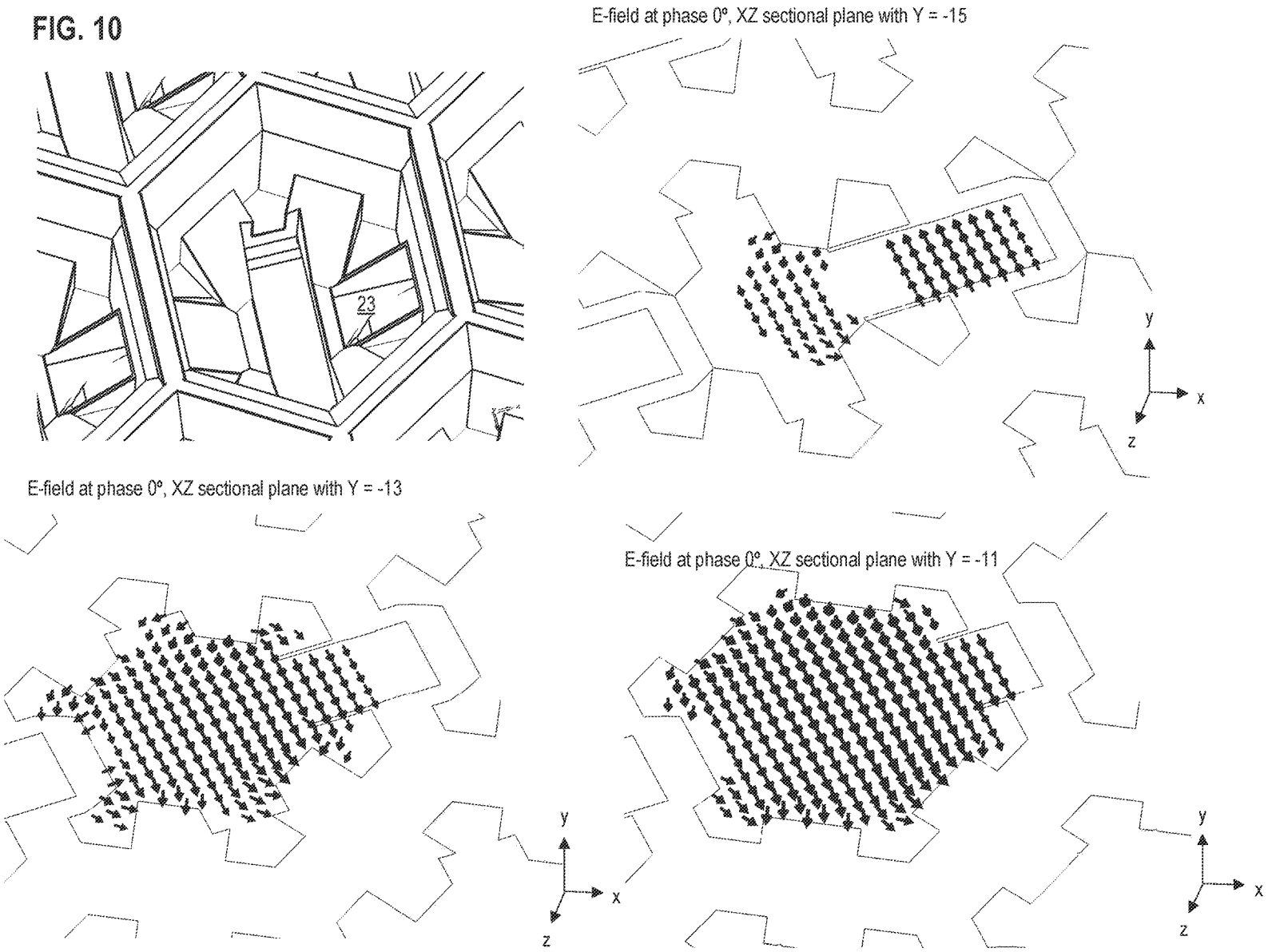
FIG. 10: three diagrams of the E field at different heights of the horn radiator in accordance with the invention on an excitation of the first polarization at phase 0°.
Figure 11:
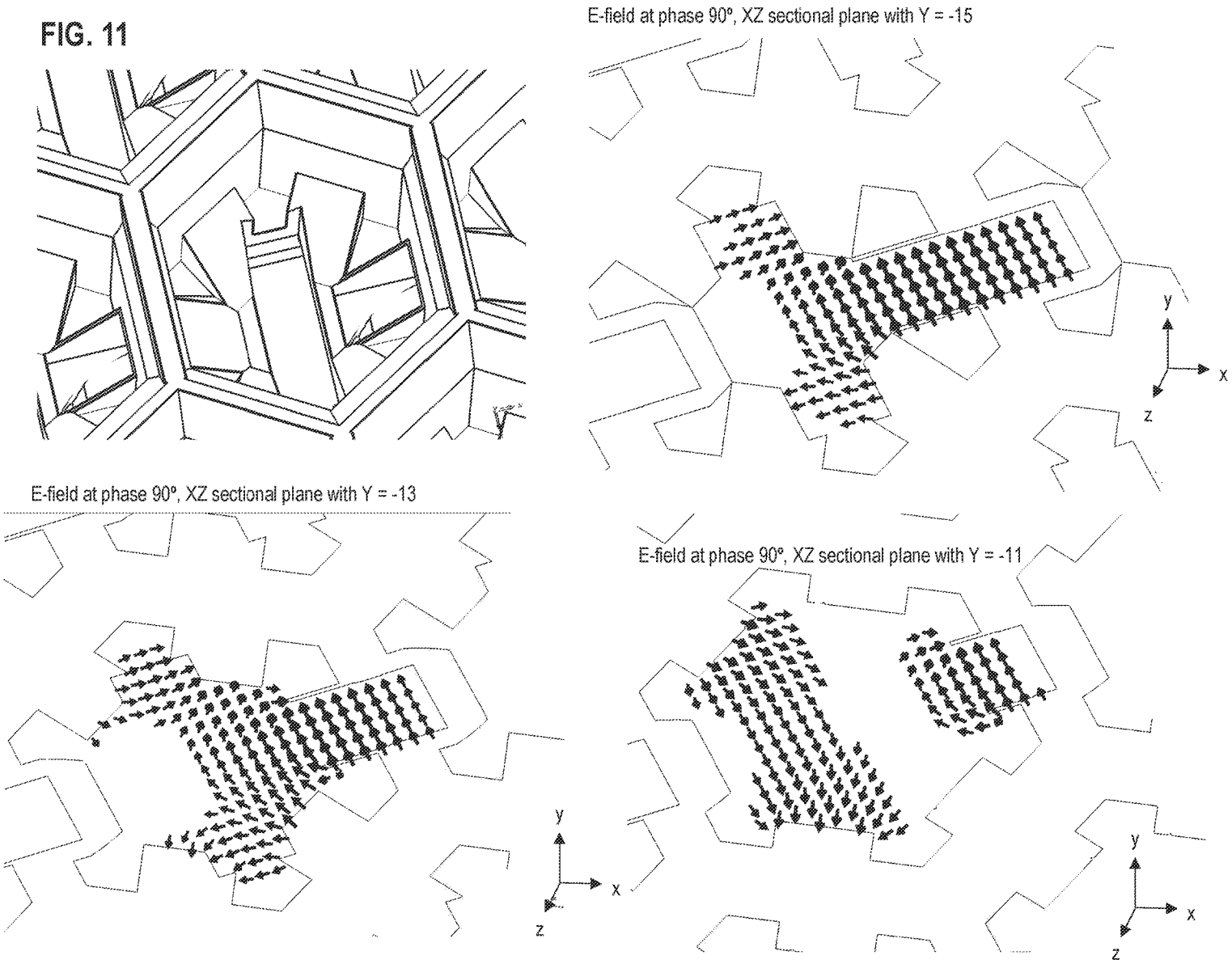
FIG. 11: three diagrams of the E field at different height levels of the horn radiator in accordance with the invention on an excitation of the first polarization at phase 90°.

In FIGS. 10 and 11, the E field is now shown at phase 0 and phase 90° in a X-Z sectional plane at different heights Y=−11, Y=−13, and Y=−15 for the first polarization that is fed via the orifice 23 at which the first hollow waveguide 1 opens into the horn radiator. As can be seen from the Figures, an exceptional orientation of the E field, and thus exceptional polarization and symmetry properties, already results in the vertical region of the orifice 23.

Figure 12:
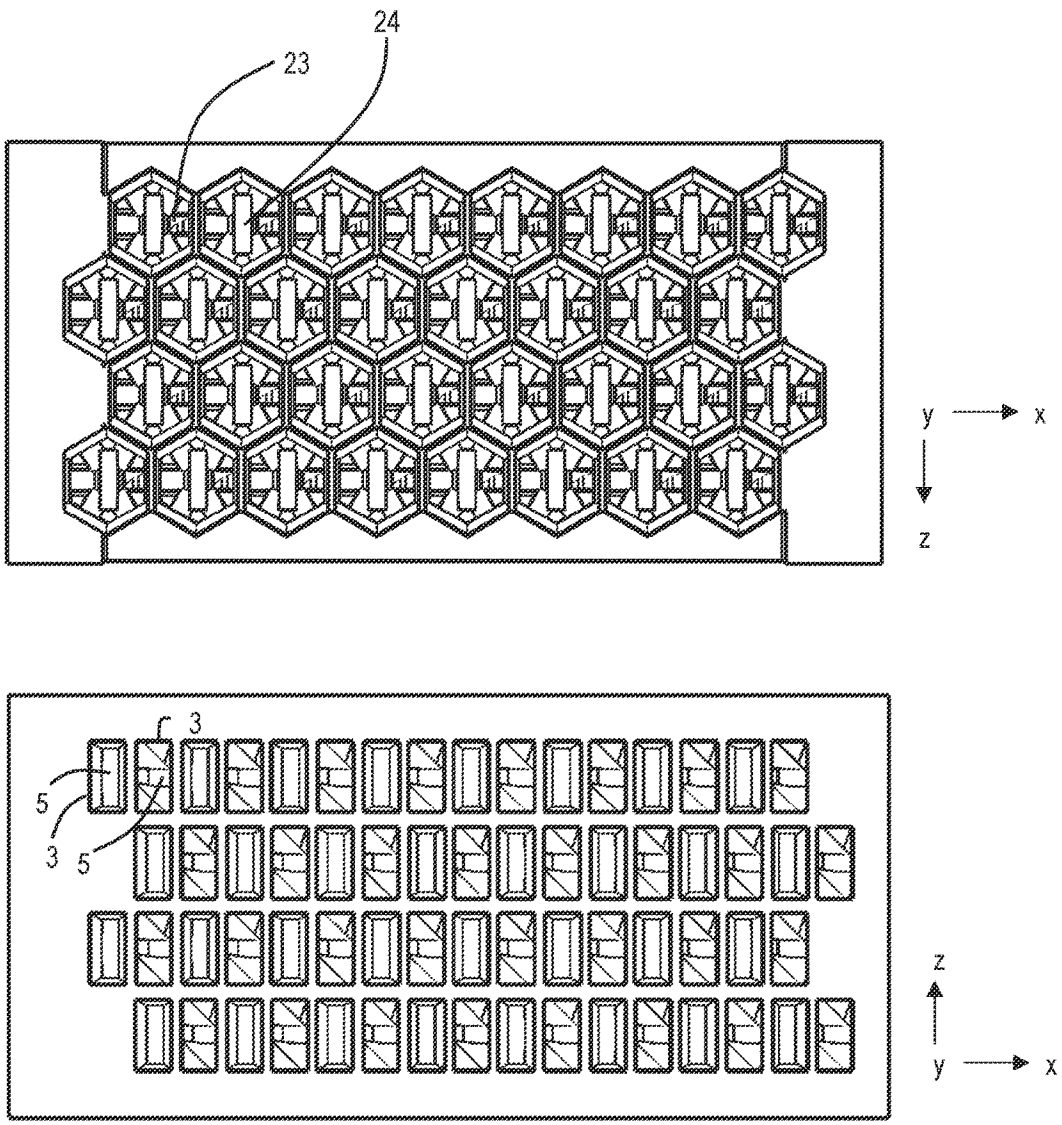
FIG. 12: top, a plan view of the embodiment of a radiator array in accordance with the invention shown in FIG. 9 and, bottom, a view of the embodiment seen from the side of the distribution network, i.e. from below.

The embodiment shown in FIG. 9 is shown in FIG. 12 in a plan view at the top in which the first orifice 23 for the first hollow waveguide and the second orifice 24 for the second hollow waveguide can be easily recognized. A view from below is shown at the bottom, and indeed in the region of the feed section. The first and second hollow waveguides here each have the same orientation and the same cross-section and each arranged in a row along the columns. The cross-section 5 that is reduced in size and that is rotated in the first hollow waveguides can furthermore be recognized in the opening region through the transformation section.

Figure 13:
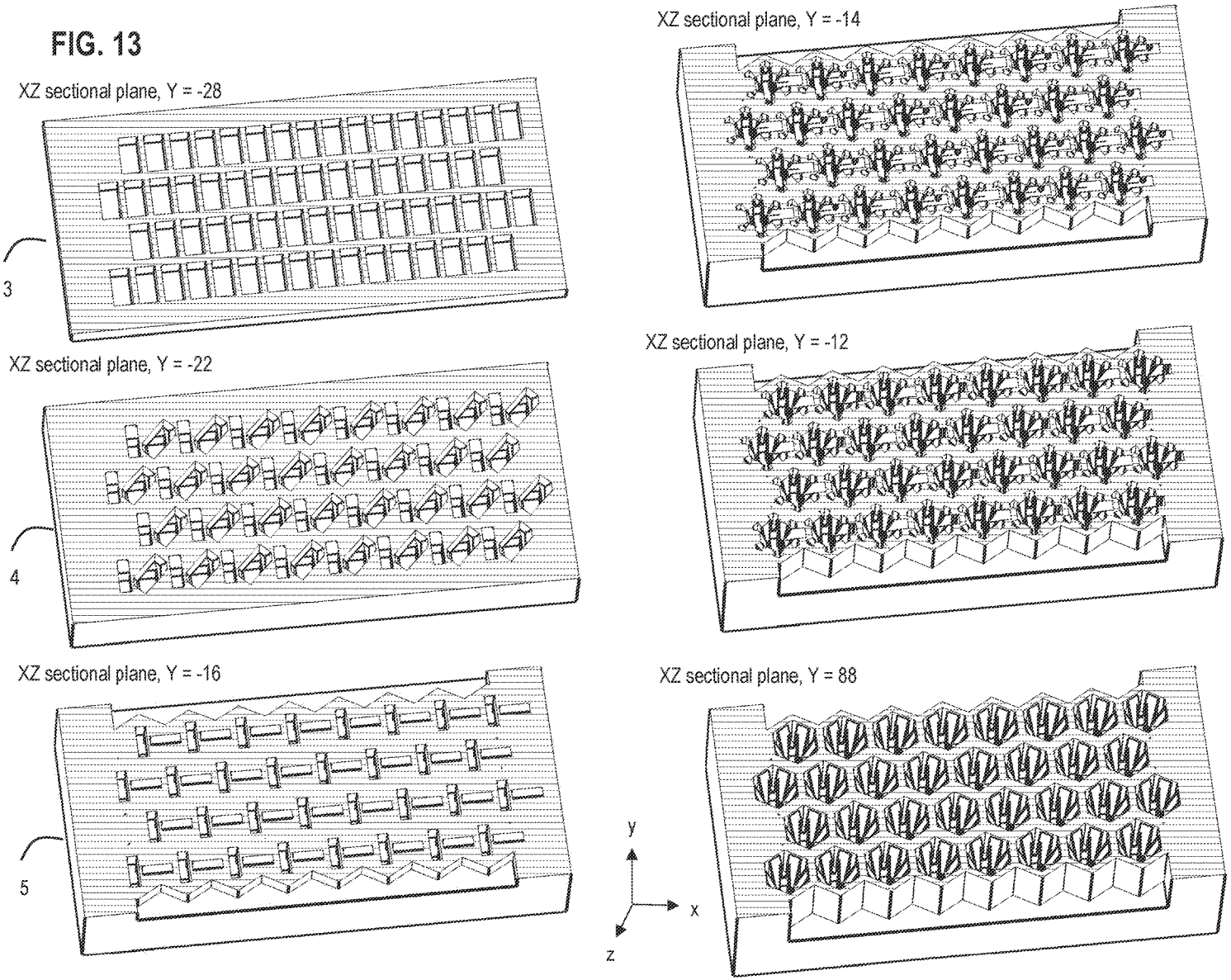
FIG. 13: 6 sections at different height levels through the embodiment shown in FIG. 9.
Figure 14:
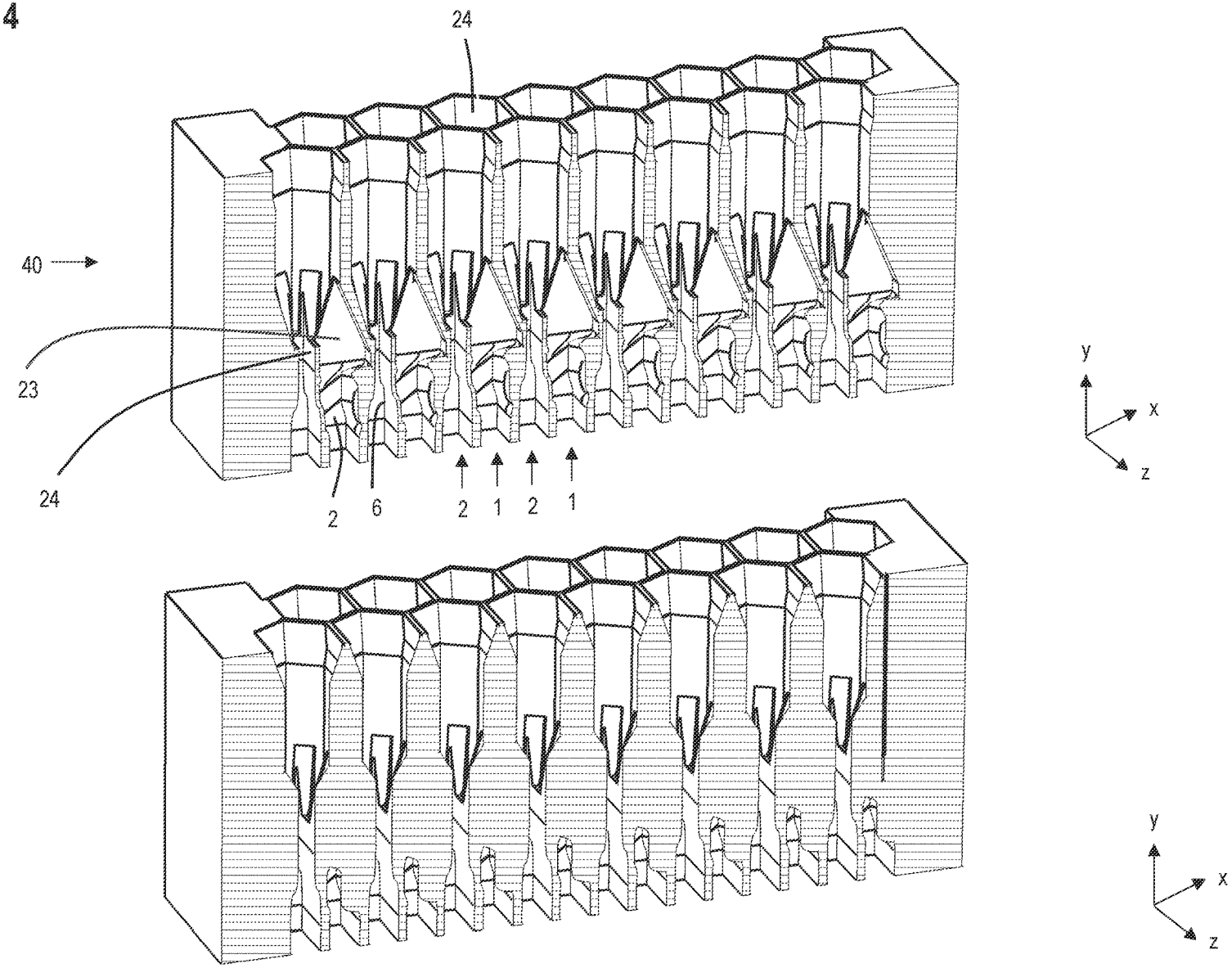
FIG. 14: two sections in the vertical direction through the embodiment shown in FIG. 9.

Sections are again shown in parallel with the aperture plane for different heights in FIG. 13, with a section through the feed section 3 being shown at the top left, a section through the transformation section 4 at the middle left, and a section through the opening section 5 at the bottom left. Sections are then shown at the top right and middle right through the superposition region in which the orifice 23 extends and a section through the horn above the superposition region is shown at the bottom right.

Figure 15:
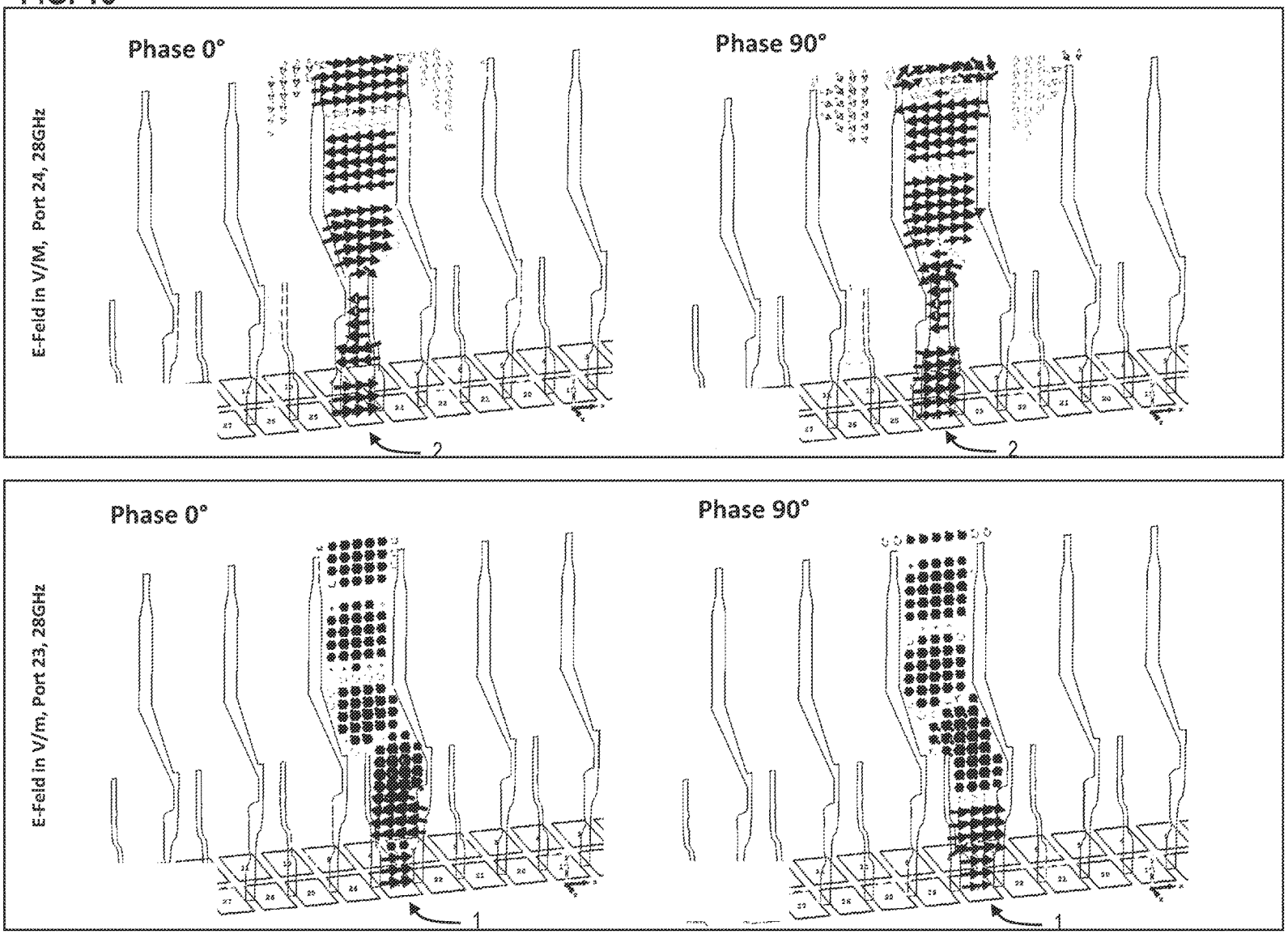
FIG. 15: top, the E field in a horn radiator on an excitation of the second polarization and, bottom, the E field on an excitation of the first polarization, in each case at 0° and 90°.

Sections perpendicular to the aperture plane along the columns are shown in FIG. 15. The extremely compact arrangement of both the horns and the hollow waveguides that supply the horn radiators with signals can be recognized very well here. In this respect, a first hollow waveguide and a second hollow waveguide are respectively alternately provided along a column, with the second hollow waveguides each being arranged centrally below the respective horn radiator and the first hollow waveguides in contrast between two horn radiators.

In FIG. 15, the E field for the two polarizations is shown, and indeed at the top for an opening 24, i.e. a port fed by a second hollow waveguide and at the bottom for an opening 23, i.e. a port fed by a first hollow waveguide. As the Figures impressively document, the horn radiators have a very good orthogonality of the two polarizations and a very uniform field distribution.

Figure 16A:
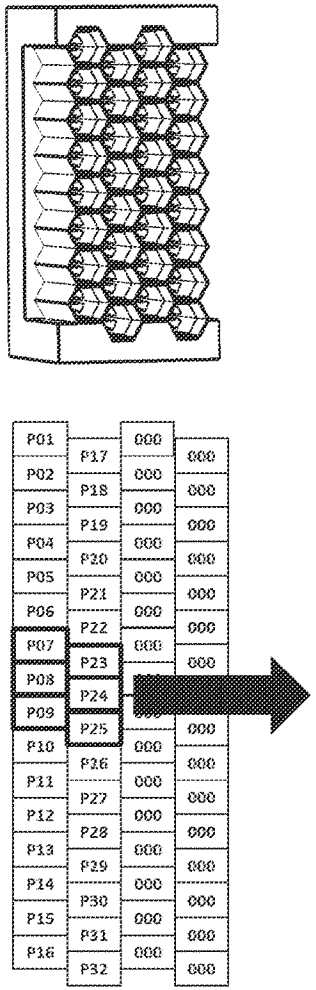
FIG. 16A: the S parameter in a Smith chart in the region between 27 GHz and 32 GHz for the ports shown on the left.
Figure 16A:
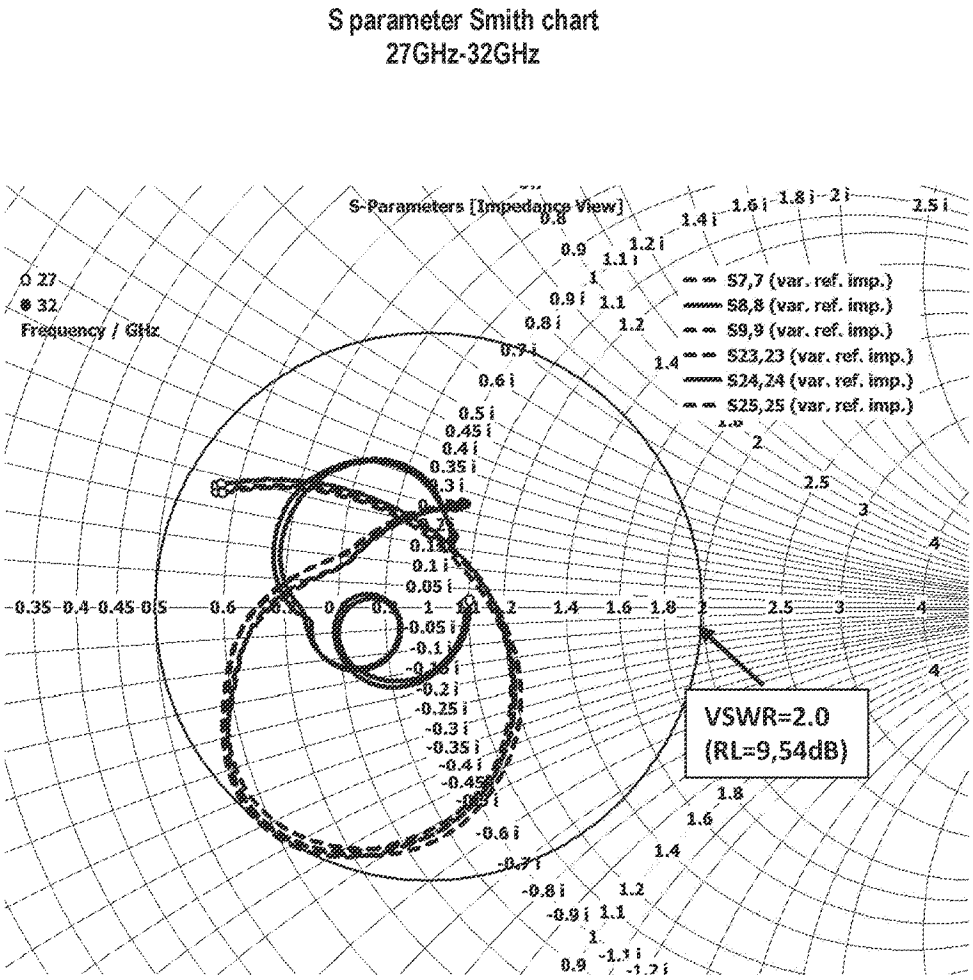
Figure 16B:
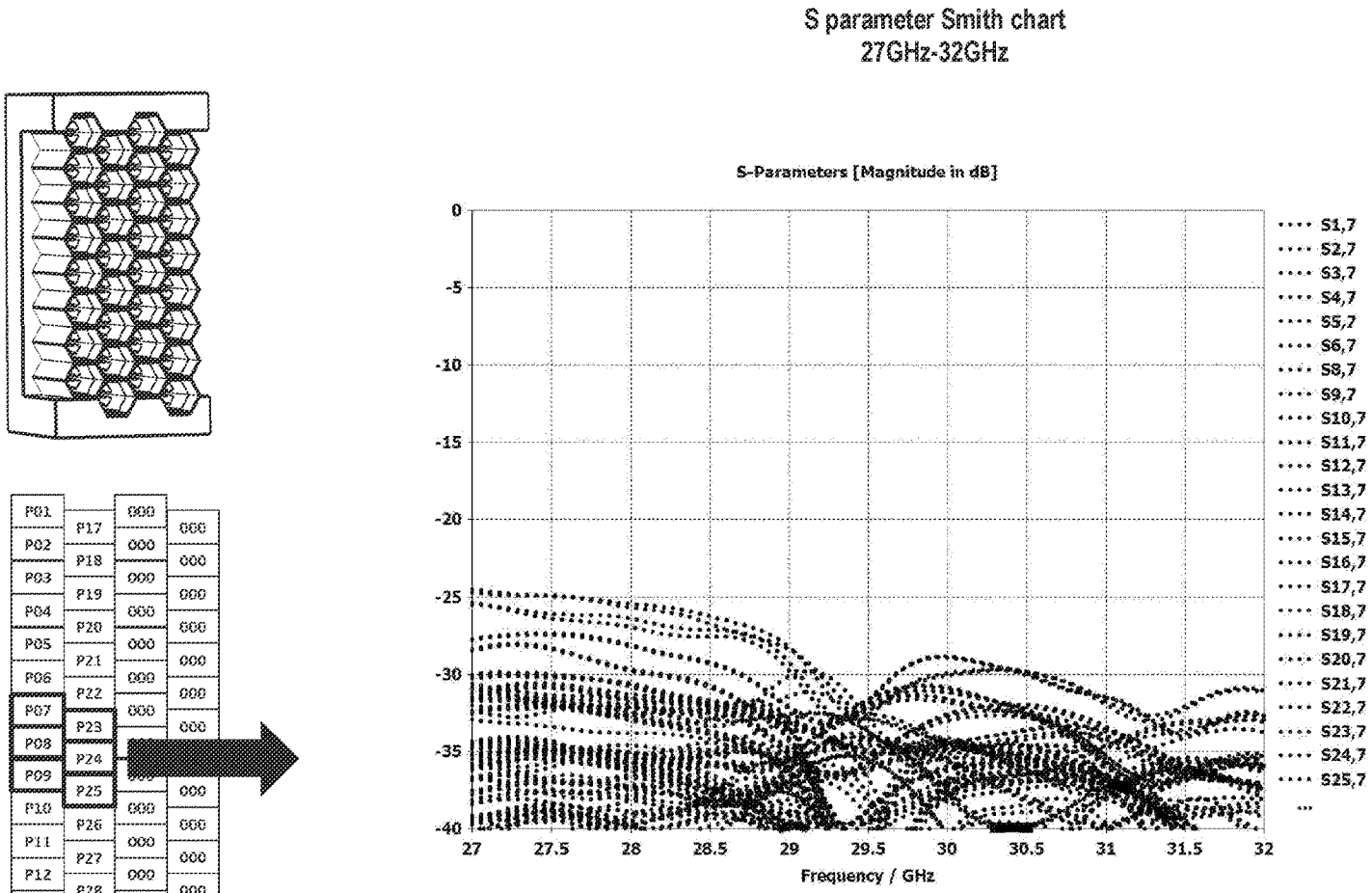
FIG. 16B: a diagram of the S parameter for the isolation between the individual ports for the frequency range between 27 GHz and 32 GHz.
Figure 17A:
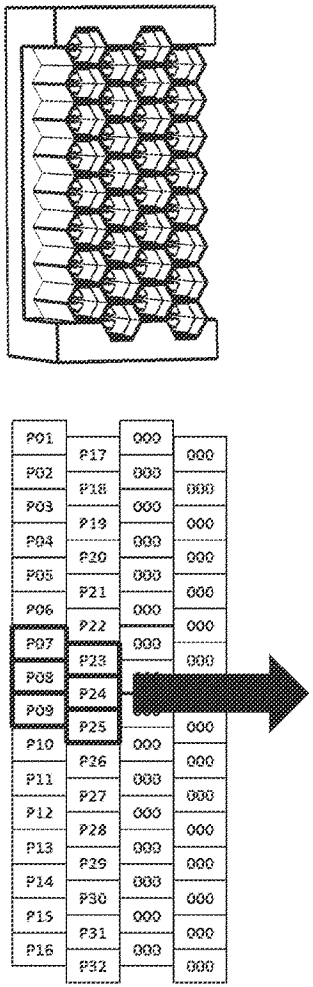
FIG. 17A: the S parameter in a Smith chart for the frequency range between 27.5 GHz and 28.5 GHz.
Figure 17A:
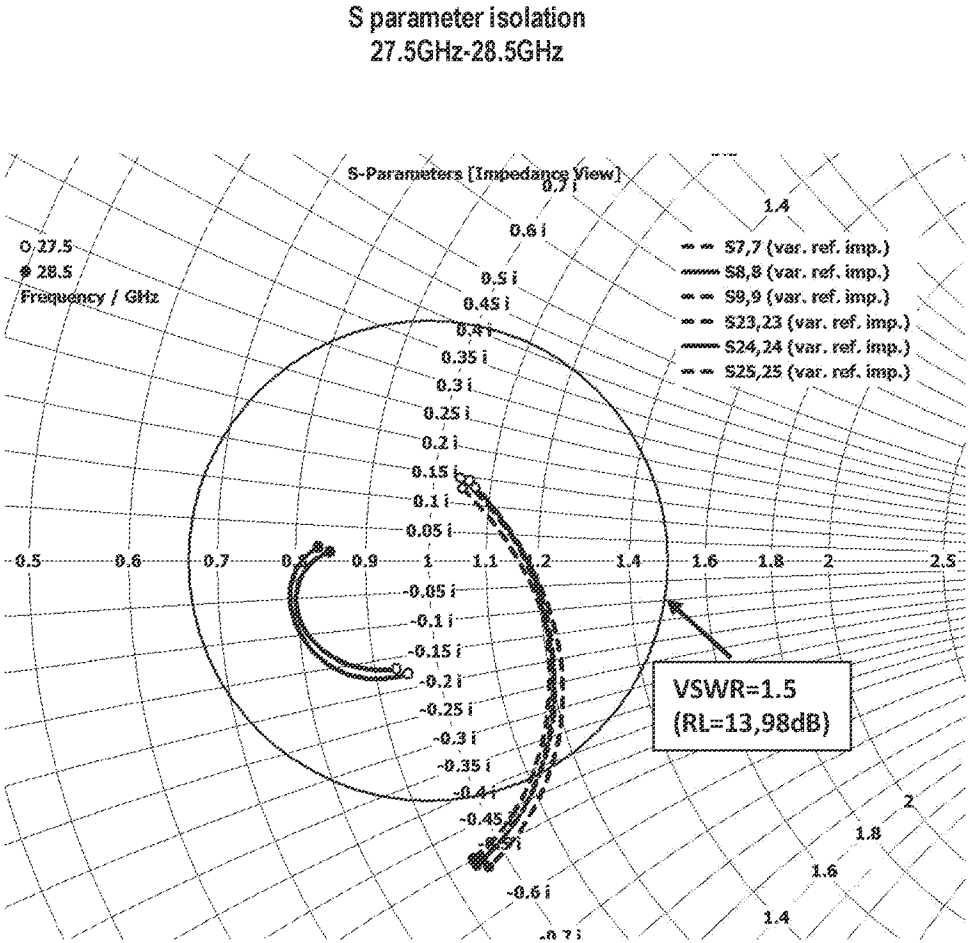
Figure 17B:
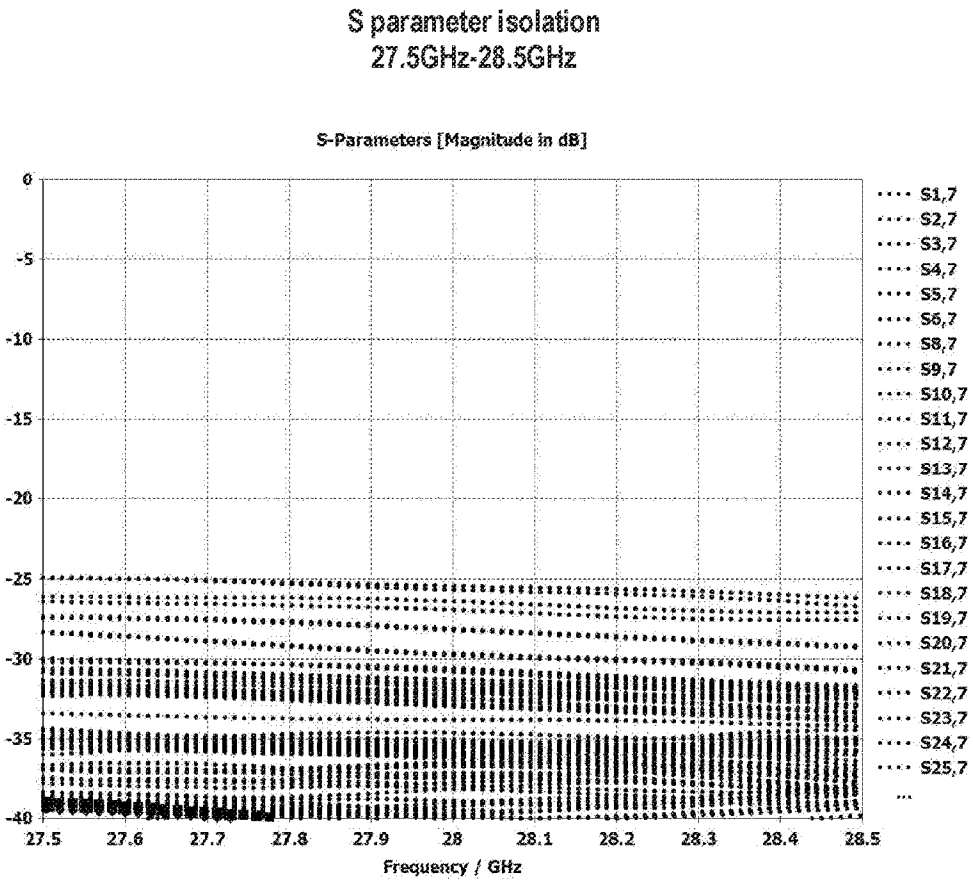
FIG. 17B: the S parameter for the isolation between the individual ports in a frequency range between 20.5 GHz and 28.5 GHz.
Figure 17B:
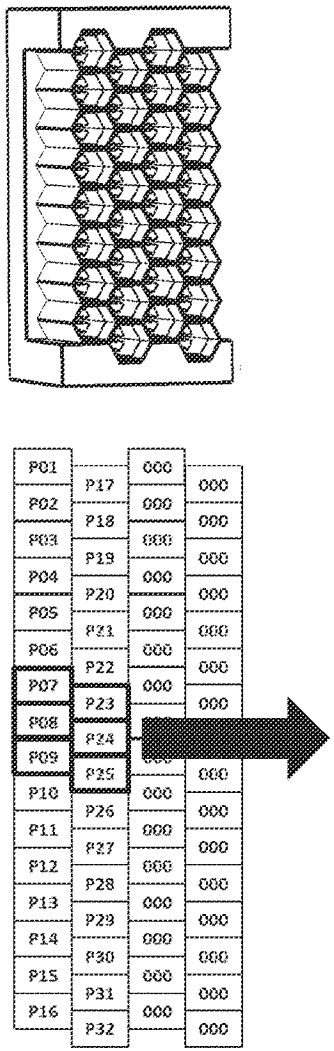

The S parameter for the individual ports in the range between 27 GHz and 32 GHz, i.e. at 17% relative bandwidth, is drawn in FIGS. 16A and 16B; in the region 27.5 GHz to 28.5 GHz, i.e. at 3.6% relative bandwidth, in FIGS. 17A and 17B. FIGS. 16A and 17A respectively show the matching in the Smith diagram, FIGS. 16B and 17B show the isolation of the ports between one another.

A VSWR of 2.0, i.e. a matching of more than 9.54 dB is drawn in FIG. 16A; a VSWR of 1.5, i.e. a matching of more than 13.98 dB is drawn in FIG. 17A. The potential is, however, actually substantially higher. The decoupling in both cases is more than 25 dB.

Figure 18:
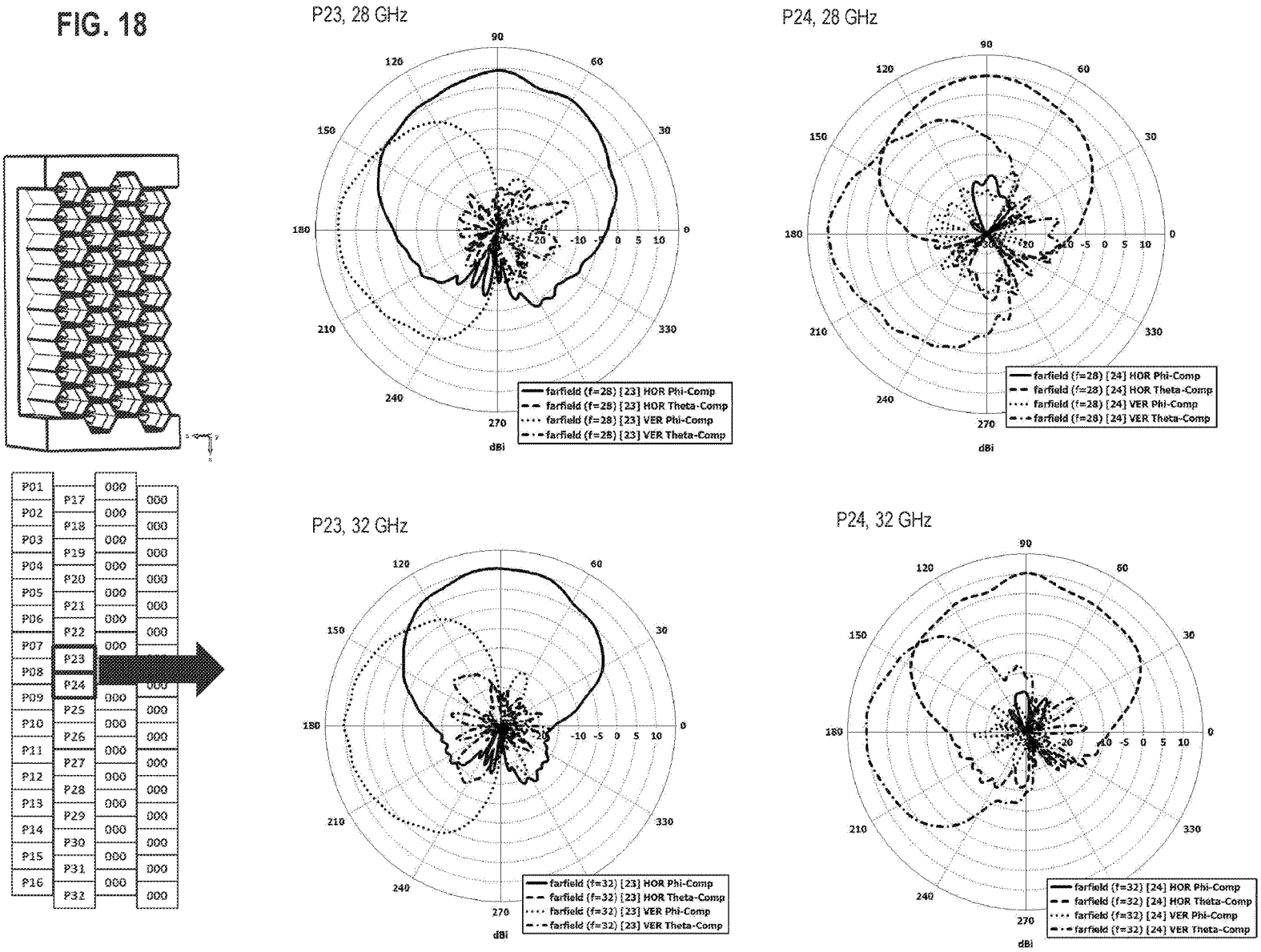
FIG. 18: the far field diagram in the horizontal and vertical directions for the two ports shown on the left in each case at 28 GHZ and 32 GHz.

The respective far field at 28 GHz or 32 GHz for the ports P23 and P24 is shown in FIG. 18. The far field is drawn in the horizontal and vertical planes, with the phi component respectively reproducing the co-polarization and the theta component respectively reproducing the cross-polarization. These diagrams also show the exceptional symmetry of the far field and the low cross-polarization.

In the embodiment of a radiator array, the individual radiators of adjacent columns are arranged offset from one another. Viewed in the column direction, the radiators of a first column are in particular arranged centrally between the radiators of the adjacent second column.

Due to the hexagonal shape of the individual radiators used selected in the previously described embodiment and the approximately equal individual radiator distances within the column and between two columns, an ideal coverage of the area hereby results due to the honeycomb structure produced.

Figure 19:
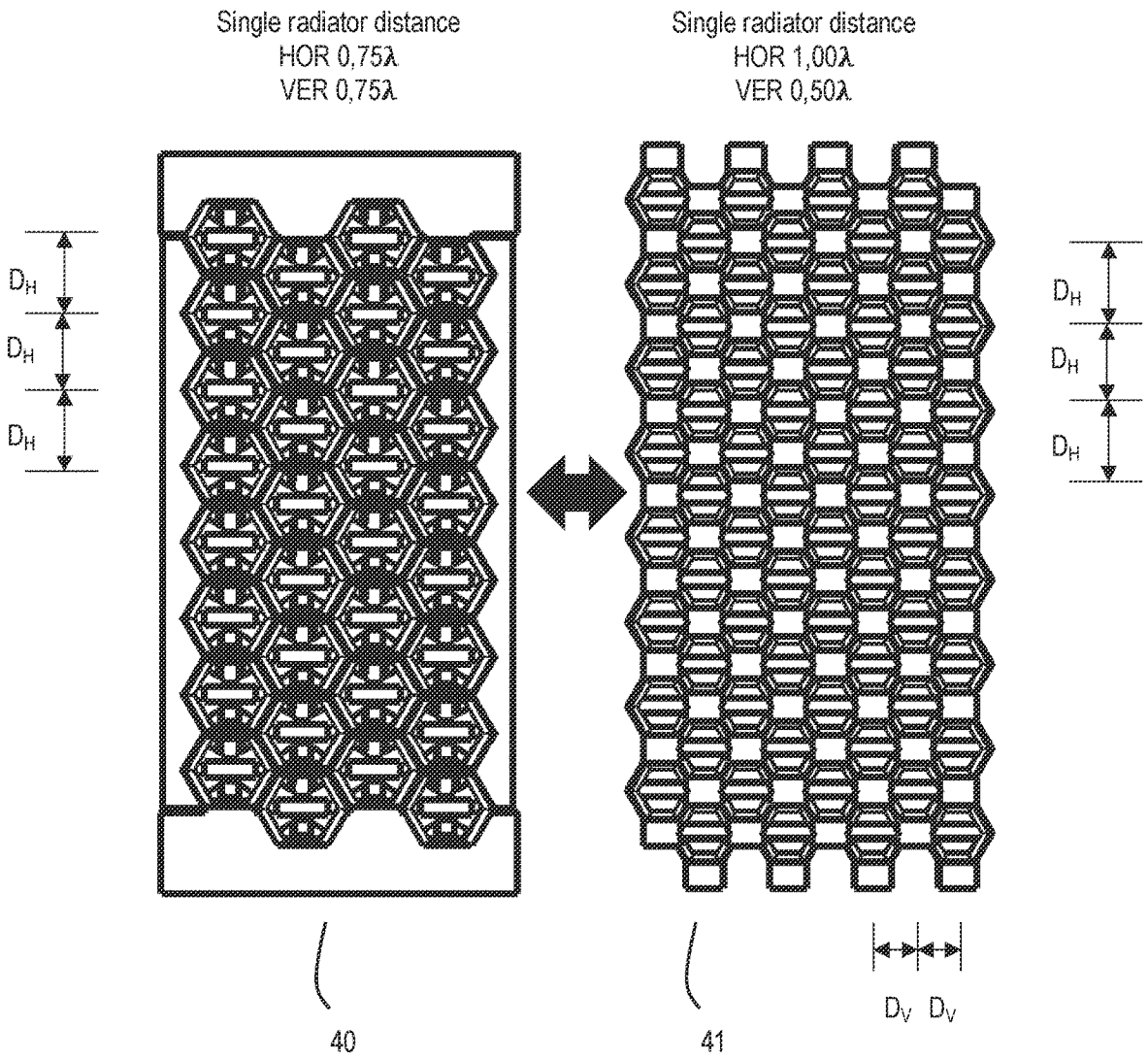
FIG. 19: the embodiment shown in FIG. 9 in a plan view and an alternative embodiment in a plan view to illustrate the possible single individual radiator distances in accordance with the invention in the horizontal and vertical directions.

The present invention, however, also allows other basic shapes of the radiator and/or a non-honeycombed arrangement. FIG. 19 here shows two embodiments of radiator arrays in accordance with the invention.

An embodiment is shown at the left that substantially corresponds to the embodiment in FIG. 9 already discussed above and that has a honeycomb structure having hexagonal individual radiators. The individual radiators here, however, have an individual radiator distance in the horizontal direction Dh of 0.75λ, and an individual radiator distance Dv in the vertical direction of 0.75λ, i.e. the individual radiators are slightly smaller than those in the embodiment in FIG. 9.

An alternative embodiment is shown at the right in FIG. 19 in which the individual radiator distance in the horizontal direction Dh, i.e. within the column, has been increased in favor of a smaller individual radiator distance in the vertical direction, i.e. between the columns. The sum of the distances Dh and Dv is here preferably smaller than 2λ and further preferably smaller than 1.5λ.

In the embodiment, the radiators have an individual radiator distance in the horizontal direction Dh of 1λ, and an individual radiator distance in the vertical direction Dv of 0.5λ.

In the embodiment, distance spaces are arranged between the radiators within the column by which the distance of the radiators within the radiators is increased and into which the radiators of the adjacent columns laterally reach. The columns can hereby be arranged with a smaller column distance. In the embodiment, a hexagonal basic shape is again used here, however, an octagonal basic shape would also be conceivable.

Figure 20:
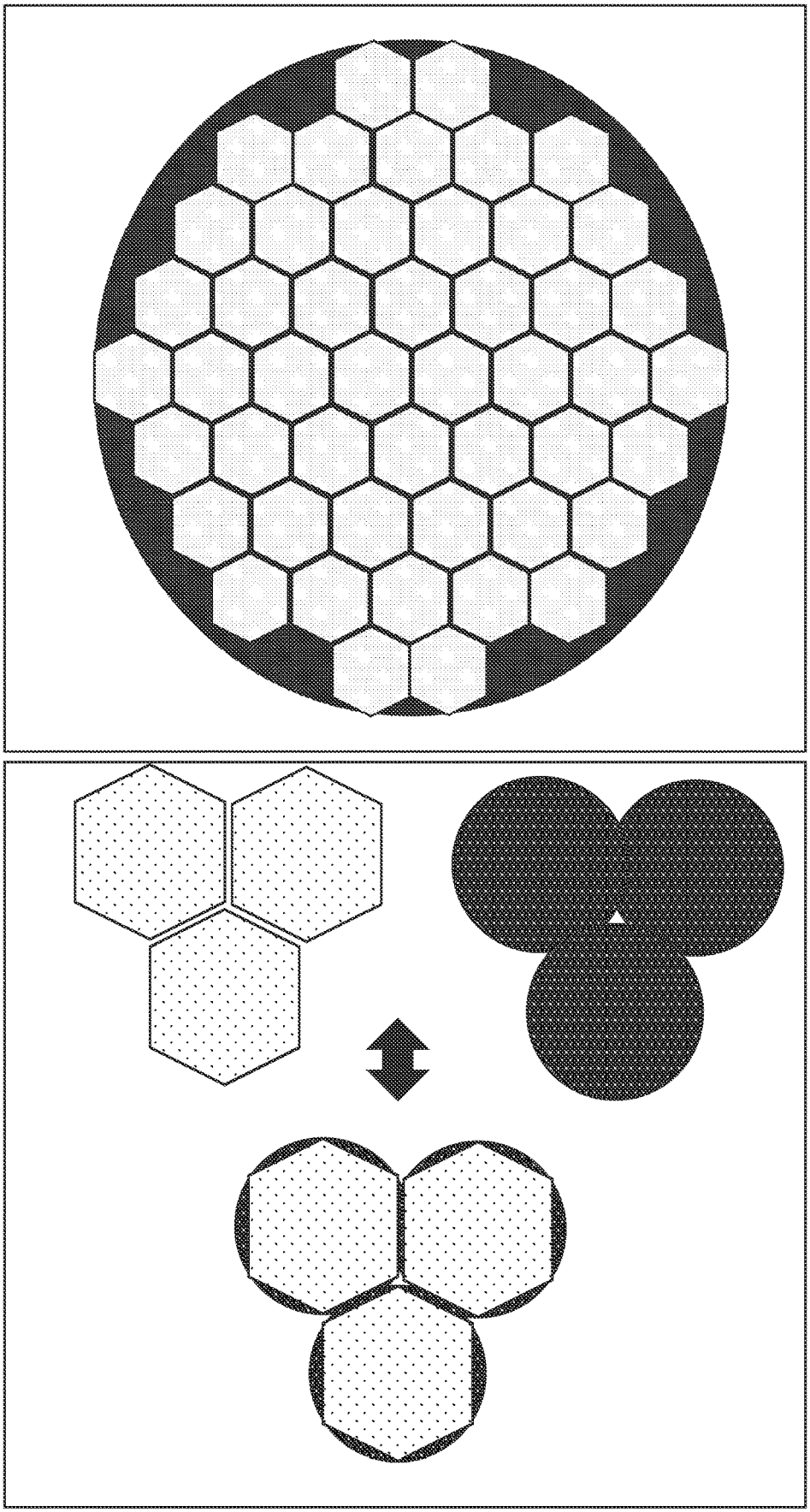
FIG. 20: three variants for the base area or aperture orifice of the horn radiators in accordance with the invention.

As shown at the left in FIG. 20, a different embodiment is also conceivable instead of a hexagonal basic shape. For example, the individual radiators can have a circular basic shape that is arranged partially overlapping.

FIG. 20 furthermore shows at the right a radiator array having an approximately circular group aperture. An approximately circular arrangement of the individual radiators can, for example, produce lower secondary lobes in the antenna diagram on an interconnection of the individual radiators with different amplitudes and phases.

The individual radiators of a radiator array in accordance with the invention can be individually fed and/or matched or can be partially interconnected in subgroups over a distribution network and matching network.

Figure 21:
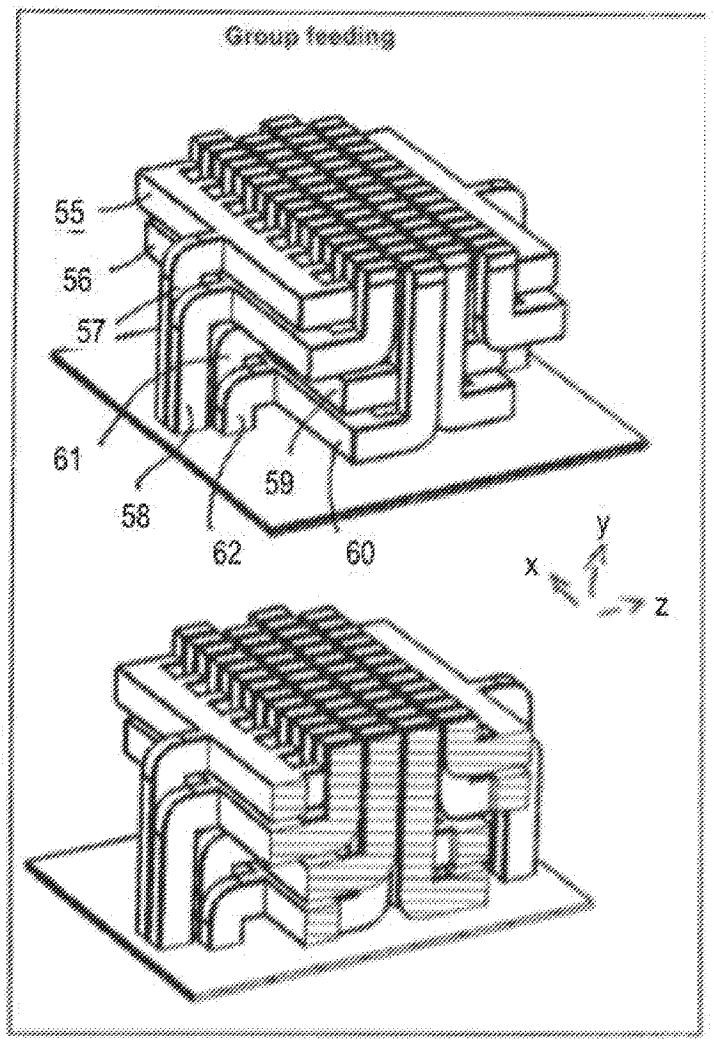
FIG. 21: two possible embodiments for a feed network for a radiator array in accordance with the invention, with an embodiment being shown on the left with an individual feed of the individual ports and an embodiment being shown on the right with a group feed of the respective identical polarizations within a column.
Figure 21:
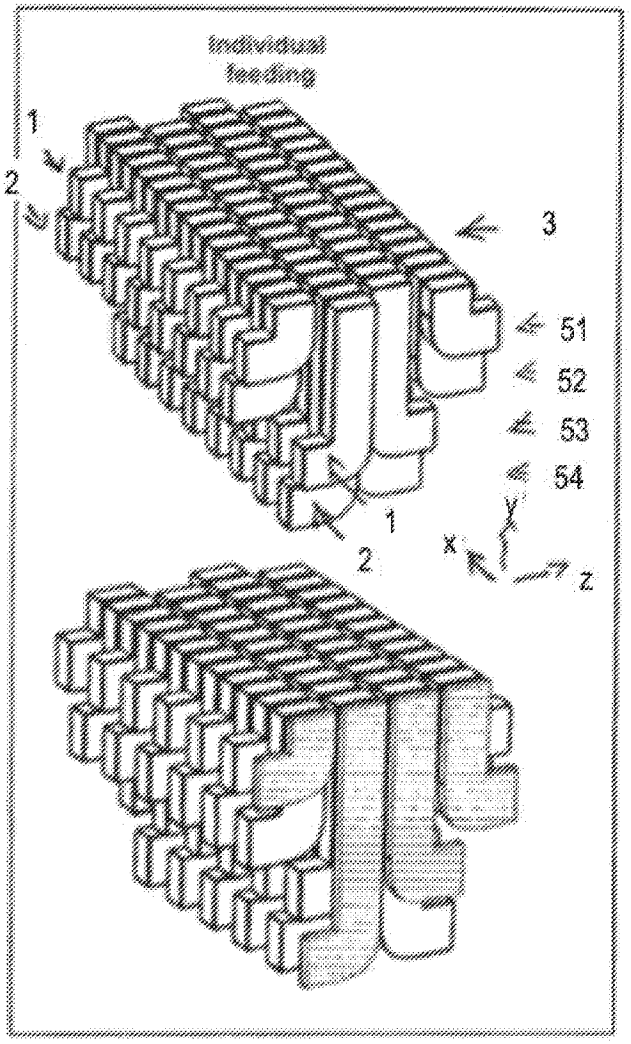

FIG. 21 shows on the left an embodiment of a feed network with individual feeding, and on the right with group feeding. The distribution network and matching network shown can here be connected to the feed sections of the first and second hollow waveguides of the horn radiators in accordance with the invention.

It is common to both configurations that the hollow waveguides are each guided to the side via bends in different planes 51 to 54.

The first hollow waveguides 1 and the second hollow waveguides 2 of a column are here in particular led out to the side in respective different planes. The hollow waveguides that supply different columns are furthermore also arranged in different planes.

Distributors 55, 56, 59, and 60 are provided in the group feeding here by which the respective first radiators 1 (distributors 55 and 59) and the second hollow waveguides (distributors 56 and 50) of a column are interconnected. The distributors are then connected to a feed arranged on a PCB via a further bend and filters 57, 58, 61, and 62.

The radiators in accordance with the present invention are in particular suitable in a frequency range between 10 GHz and 100 GHz or for 5G applications, in particular applications with beam steering and/or beam forming.

The invention claimed is:

1. A dual polarized horn radiator comprising a first horn radiator and a second horn radiator each having a first polarization and a second polarization, the first horn radiator and the second horn radiator are disposed adjacently but fed separately from one another via a first hollow waveguide and a second hollow waveguide, wherein at least one of the first, hollow waveguide and the second hollow waveguide runs in a direction of a beam to an opening region at which the at least one of the first hollow waveguide and the second hollow waveguide opens into a respective one of the first horn radiator and the second horn radiator and in so doing has a cross-section that extends in projection onto an aperture plane that is partly within an aperture orifice of the first horn radiator and partly within an aperture orifice of the second horn radiator.

2. The dual polarized horn radiator in accordance with claim 1, wherein the cross-section of the at least one of the first hollow waveguide and the second hollow waveguide runs in projection onto an aperture plane below the aperture orifice of the first horn radiator and the second horn radiator; and/or wherein the at least one of the first hollow waveguide and the second hollow waveguide has a front-face boundary wall that extends from a position that is disposed in projection onto an aperture plane outside the aperture orifice of the first horn radiator and the second horn radiator to an edge of the opening region into the respective one of the first horn radiator and the second horn radiator, with the boundary wall running obliquely to the aperture plane.

3. The dual polarized horn radiator in accordance with claim 1, wherein the opening region at which the at least one of one of the first or second hollow waveguides into the horn radiator has an extent along a long side in parallel with the aperture plane or perpendicular to the aperture plane; wherein an outer short side of the opening region is arranged higher than the oppositely disposed inner short side of the opening region; and/or wherein the long side of the opening region of the hollow waveguide is arranged in a base region of the horn radiator running obliquely to the aperture plane and/or runs obliquely to the aperture plane; and/or wherein the extent in parallel with the aperture plane and the extent perpendicular to the aperture plane preferably have a ratio between 1:1 and 1:8; and/or wherein the extent in parallel with the aperture plane amounts to between 0.05λ, and 0.4λ; and/or wherein the extent perpendicular to the aperture plane amounts to between 0.05λ, and 1.5λ, where λ is a wavelength of a center frequency of a resonant frequency range of the horn radiator.

4. The dual polarized horn radiator in accordance with claim 1, wherein one of the first or second hollow waveguides is guided in the direction of the beam to the horn radiator; wherein the cross-section that extends in projection onto the aperture plane is located within the opening region; and/or wherein the opening region of one of the first, or second hollow waveguides into the horn radiator is arranged centrally with respect to the aperture orifice; and/or wherein a base of the horn radiator has a funnel-like region and the opening region of the one of the first or second hollow waveguides is arranged at the tip of the funnel-like region.

5. The dual polarized horn radiator in accordance with claim 1, wherein at least one horn region has material cutouts and/or material insertions; and/or in that the horn radiator forms a ridge hollow waveguide radiator with side walls or without, side walls; and/or the ridges have a funnel shape and/or an exponential shape in the vertical direction on their inwardly facing side.

6. The dual polarized horn radiator accordance with claim 1, wherein the horn radiator has a resonant frequency range in a range between 10 GHz and 100 GHz; and/or wherein a maximum diameter of the aperture orifice of the horn radiator amounts to between 0.3λ and 1.4λ; and/or wherein the horn radiator has a height between 0.5λ and 4λ, with λ being the wavelength of a center frequency of a resonant frequency range of the horn radiator; and/or wherein the horn of the horn radiator has a first horn region having side walls extending substantially in a main direction of the beam and a second horn region having side walls expanding in a funnel-like manner, with the height of the second horn region being smaller than the height of the first horn region; and/or wherein the widening of the aperture opening in the second horn region is smaller than 50%; and/or wherein the first and second horn regions continuously merge into one another; and/or wherein the horn radiator has a hexagonal or round aperture orifice.

7. A dual polarized horn radiator comprising a first horn radiator and a second horn radiator each having a first polarization and having a second polarization, the first horn radiator and the second horn radiator are fed separately from one another via a first hollow waveguide and a second hollow waveguide, wherein at least one of the first hollow waveguide and the second hollow waveguide runs in a direction of a beam to an opening region at which the at least one of the first hollow waveguide and the second hollow waveguide opens into a respective one of the first horn radiator and the second horn radiator, with the at least one of the first hollow waveguide and the second hollow waveguide having a transformation section by which a polarization of the at east one of the first hollow waveguide and the second hollow waveguide is rotated in an aperture plane with respect to another one of the at least one of the first hollow waveguide and the second hollow waveguide before the at least one of the first hollow waveguide and the second hollow waveguide opens into the respective one of the first horn radiator and the second horn radiator.

8. The dual polarized horn radiator in accordance with claim 7, wherein the first and second hollow waveguides run next to one another and/or in parallel with one another in the direction of the beam to the opening region at which the at least one of the first and second hollow waveguides into the horn radiator and/or initially have a same polarization; and/or wherein the transformation section has a twist; and/or wherein the second hollow waveguide does not have a rotation of the polarization or a rotation about a different angle than the first hollow waveguide, wherein the second hollow waveguide has no twist or a different twist than the first hollow waveguide; and/or wherein a cross-section of the first, hollow waveguide reduces in the transformation section, and/or wherein the second hollow waveguide has a transformation section in which its cross-section reduces.

9. The dual polarized horn radiator in accordance with claim 8, wherein the first and second hollow waveguides have a cross-section having a long side and a short side with the long sides of the first and second hollow waveguides initially running in parallel with one another; and/or wherein the long sides of the first and second hollow waveguides are perpendicular to one another at the end of the transformation section due to twist; and/or wherein the reduction of the cross-section comprises at least a reduction of the short side and/or an increase of the ratio between the long side and the short side; and/or wherein the transformation section transforms at least one cross-section widening into a cross-section constriction, and/or wherein the cross-sections of adjacent hollow waveguides are interlaced.

10. A radiator array comprising a plurality of dual polarized horn radiators arranged next to one, another in a column or a row, wherein each of the plurality of dual polarized horn radiators comprises a first horn radiator and a second horn radiator each having a first polarization and a second polarization, the first horn radiator and the second horn radiator in each of the plurality of dual polarized horn radiators are disposed adjacently and separately fed by a first hollow waveguide and a second hollow waveguide, wherein at least one of the following conditions is met:

a) the first hollow waveguide and the second hollow waveguide of the column or the row are each guided in a direction of a beam to an opening region at which each of the first hollow waveguide and the second hollow waveguide opens into a respective one of the first horn radiator and the second horn radiator, with the second hollow waveguide in the column or the row having a transformation section by which a polarization of the second hollow waveguide in an aperture plane is rotated before the second hollow waveguide opens into the second horn radiator; and b) at least one of the first hollow waveguide and the second hollow waveguide of a respective one of the plurality of horn radiators runs in a direction of a beam to the opening region at which the at least one of the first hollow waveguide, and the second hollow waveguide opens into a respective one of the first horn radiator and the second horn radiator and in so doing a cross-section of the at least one of the hollow waveguides runs in projection onto the aperture plane partly within an aperture orifice of the first radiator and partly within an aperture orifice of the second horn radiator.

11. The radiator array in accordance with claim 10, wherein the horn radiators have a resonant frequency range in a range between 10 GHz and 100 GHz and/or wherein the individual radiator distance in the column and/or row amounts to less than 1λ, and/or wherein the horn radiators are arranged in a plurality of columns and/or rows arranged next to one another and the sum of the individual radiator distance in the column or row and of the individual radiator distance perpendicular to the column or row amounts to less than 2λ, with λ being the wavelength of the center frequency of a resonant frequency range of the radiator array.

12. The radiator array in accordance with claim 10, wherein the horn radiators are arranged in a plurality of columns or rows arranged next to one another.

13. The radiator array in accordance with claim 10 having a feed network, wherein the first hollow waveguides and the second hollow waveguides of the horn radiators arranged in a column or row having a bend toward a side in different vertical planes; wherein the respective first hollow waveguides of the horn radiators arranged in a column or row and/or the second hollow waveguides of the horn radiators arranged in a column or row have a bend toward the side in the same vertical plane; and/or wherein the hollow waveguides of two horn radiators arranged in two adjacent rows or columns have a bend toward the side in different vertical planes.

14. The radiator array in accordance with claim 10 having a feed network, wherein the hollow waveguides of the horn radiators are each individually fed; or wherein the first hollow waveguides of the horn radiators arranged in a column or row and/or the second hollow waveguides of the horn radiators arranged in a column or row are connected to a common feed by a distributor.

* * * * *